US005757327A

United States Patent [19]

Yajima et al.

[11] Patent Number: 5,757,327

[45] Date of Patent: May 26, 1998

[54] ANTENNA UNIT FOR USE IN NAVIGATION SYSTEM

[75] Inventors: Hideo Yajima; Toshikazu Ogino; Shinya Yamada, all of Kanagawa; Junichi Noro, Akita, all of Japan

[73] Assignee: Mitsumi Electric Co., Ltd., Tokyo, Japan

[21] Appl. No.: 508,024

[22] Filed: Jul. 27, 1995

[30] Foreign Application Priority Data

| | | | |
|---|---|---|---|
| Jul. 29, 1994 | [JP] | Japan | 6-197786 |
| Oct. 26, 1994 | [JP] | Japan | 6-286001 |
| Oct. 26, 1994 | [JP] | Japan | 6-286002 |
| Oct. 26, 1994 | [JP] | Japan | 6-286003 |
| Oct. 31, 1994 | [JP] | Japan | 6-290553 |
| Jun. 20, 1995 | [JP] | Japan | 7-176555 |
| Jun. 20, 1995 | [JP] | Japan | 7-176560 |

[51] Int. Cl.[6] ..... H01Q 1/32

[52] U.S. Cl. ..... 343/713; 343/872; 343/700 MS

[58] Field of Search ..... 343/872, 711, 343/713, 700 MS, 873, 712, 716; H01Q 1/32

[56] References Cited

U.S. PATENT DOCUMENTS

| | | | |
|---|---|---|---|
| 3,245,165 | 4/1966 | Podoloff | 40/129 |
| 3,633,206 | 1/1972 | McMillan | 343/770 |
| 3,910,540 | 10/1975 | Kayler | 248/206 A |
| 4,398,199 | 8/1983 | Makimoto et al. | 343/700 MS |
| 4,520,364 | 5/1985 | Perry | 343/872 |
| 4,605,292 | 8/1986 | McIntosh | 350/641 |
| 4,675,685 | 6/1987 | Finken | 343/708 |
| 4,896,165 | 1/1990 | Koizumi | 343/881 |
| 5,294,938 | 3/1994 | Matsuo et al. | 343/872 |
| 5,298,894 | 3/1994 | Cerny et al. | 343/872 |

FOREIGN PATENT DOCUMENTS

| | | | |
|---|---|---|---|
| 3-276904 | 12/1991 | Japan . | |
| 3-726902 | 12/1991 | Japan . | |
| 4-152704 | 5/1992 | Japan | H01Q 1/42 |
| 6-140824 | 5/1994 | Japan | H01Q 1/42 |
| 742210 | 7/1995 | Japan . | |
| 742214 | 7/1995 | Japan . | |
| 742523 | 8/1995 | Japan . | |

*Primary Examiner*—Hoanganh T. Le

*Attorney, Agent, or Firm*—Whitham, Curtis, Whitham & McGinn

[57] ABSTRACT

An antenna unit for use in a navigation system includes a bottom cover and a unit case, a circuit board and an antenna main body are stored in the bottom cover, a cylindrical storage portion in the bottom cover is for storing the circuit board and the antenna main body therein, the cylindrical storage portion being formed integrally with the surface of the bottom cover, a cylindrical joint portion being threaded with the cylindrical storage portion, said cylindrical joint portion being formed integrally in the unit case, and the cylindrical joint portion being threaded with the cylindrical storage portion.

17 Claims, 14 Drawing Sheets

ANTENNA UNIT FOR USE IN NAVIGATION SYSTEM

BACKGROUND OF THE INVENTION

Field of the Invention

1. The present invention relates to an improved antenna unit provided on the receiving side of a navigation system. The present invention relates also to an antenna unit and, in particular, to an antenna unit including a case composed of a bottom cover and a top cover for storing therein a circuit board, an antenna main body and the like. The present invention further relates to an antenna unit and, in particular, to an antenna unit in which a sheet for preventing the unit installation portion from being damaged is bonded to the bottom surface of an antenna main body for storing therein a circuit board, an antenna main body, a mounting magnet and the like. The present invention still further relates to an antenna unit and, in particular, to a plane antenna unit for use in a GPS (a global positioning system) and, in particular, to a case formed of resin for storing a plane antenna element therein.

2. Related art

As is commonly known, as an antenna unit on the receiving side of a navigation system, there is known such an antenna unit as shown in FIGS. 4 and 5. That is, this antenna unit can be attracted onto the surface of an object, onto which the antenna unit is mounted, such as a vehicle roof panel X or the like as the need arises, and includes a bottom cover A formed of zinc or aluminum by die casting and a circular unit case B the bottom surface of which is covered by the bottom cover A. In the unit case B, there are stored a unit circuit board C on which a large number of circuit elements can be assembled, and an antenna main body D for receiving an electric wave from a stationary satellite or the like.

In other words, in order to prevent rainwater and the like from invading into the bottom cover A and the unit case B cooperating in forming the outer case of the antenna unit, there is interposed a waterproof seal E between the bottom cover A and unit case B, and the bottom cover A and unit case B can be assembled together by use of a plurality of assembling screws F which are screwed in from the bottom surface of the bottom cover A.

Also, in order to attract the antenna unit to the surface of a target object magnetically and removably, there is formed a bottom surface recessed portion a in the bottom surface of the bottom cover A, and a back yoke H, which is formed of a ferromagnetic substance and is to be fixed by a plurality of fixing screws G, is positioned in the bottom surface recessed portion a. That is, in the outer peripheral surface of the back yoke H which can be stored within the bottom surface recessed portion a, there are bent and formed a plurality of mounting pieces h. A circular permanent magnet ring I is attracted to the surface of the back yoke H due to its own magnetic force, so that the antenna unit can be mounted onto the surface of the vehicle roof panel X or the like due to the magnetic force of the permanent magnet ring I.

In FIGS. 4 and 5, reference character J designates an antenna cord which is used to connect the antenna unit to a navigation system (not shown).

However, in the above-mentioned conventional antenna unit, since the bottom cover A and unit case B must be assembled together by use of a tool such as a screw driver or the like, the working efficiency of the assembling operation is poor, while use of the plurality of assembling screws F results in the comparatively high costs of the components.

Also, since the back yoke H of the antenna unit is fixed to the bottom cover A by use of the plurality of fixing screws G, the working efficiency of the fixing operation is similarly poor, the number of components is increased, and the costs of the components are relatively high.

Conventionally, as the antenna unit, there is also known such an antenna unit as shown in FIG. 19. This antenna unit is structured such that it can be attracted to and held in the installation position of a vehicle roof panel or the like. Also, the antenna unit includes a case which is composed of a bottom cover 501 formed of aluminum by die casting and a top cover 502 to be mounted onto the bottom cover 501. In the case, there are stored a circuit board 503 with a large number of electronic parts assembled thereon, a shield cover 503*a* formed of metal for covering the circuit board 503, an antenna main body 504 for receiving an electric wave from a stationary satellite or the like, and other components. Reference character 540 designates a cable.

Also, there is formed a recessed portion in the bottom surface of the bottom cover 501. There is disposed in the recessed portion a back yoke 507 which is formed of a ferromagnetic substance and can be fixed through a mounting piece 507*a* by use of a plurality of mounting screws 506. A ring-shaped permanent magnet 508 is attracted to and held on the lower surface side of the back yoke 507. A stabilizing shield plate 530 formed of plate metal for stabilizing the electric wave receiving state is mounted on the lower surface side of the ring-shaped permanent magnet 508, and the antenna unit can be attracted to and held in the installation portion thereof due to the magnetic force of the ring-shaped permanent magnet 508.

However, in the above-mentioned conventional antenna unit, there are still several problems to be solved. That is, as shown in FIG. 20, in the top cover 502, there is formed a draw-out opening 550 which is used to draw out a cable 540 connected to the circuit board 503. The draw-out opening 550 is formed larger than the outside diameter of the cable 540. The cable 540 is held between the draw-out opening 550 of the bottom cover 501, top cover 502, and stabilizing shield plate 530 so that the root portion of the cable 540 within the antenna unit is held in such a manner that it is movable to an extent substantially corresponding to a gap formed between the cable 540 and the above components.

For this reason, even if, in the step of packing or circulating the antenna unit, the portion of the cable 540 showing externally from the antenna unit is slightly pulled backwardly or is only slightly vibrated horizontally and vertically, such slight movement of the externally showing portion of the cable 540 can raise the stabilizing shield plate 530 in such a manner as shown by a one-dot chained line in FIG. 20, so that the shield plate 530 can be often detached from the lower surface side of the permanent magnet 508. This impairs the effectiveness of the antenna unit as a product, which results in the worsened yield of the product.

Also, in the above-mentioned conventional antenna unit, although not shown specially, when putting, assembling and fixing the top cover 502 to the bottom cover 501, several pieces of screws are threadedly inserted from the bottom surface side of the back yoke toward the bottom cover 501 and top cover 502 sides. This way of fixing together these three components by screws is generally known but requires operations to position the three components and fix them together by use of a required number of screws. Due to this, it takes time and labor to assemble and fix together the three components, and the number of parts required is large.

Further, in the above-mentioned conventional antenna unit, when mounting the magnet 508 onto the bottom cover 501, there arise the following problems:

(1) since it is necessary to fix the back yoke 507 to the bottom cover 501 by use of the screws 506, the number of parts is large and the assembling operation thereof is troublesome;

(2) since it is necessary to tap the bottom cover 501, the tapping operation takes time and labor; and, (3) the back yoke is complicated in shape and also requires a hole machining operation (for a screw). These problems also increase the manufacturing cost of the antenna unit.

Further, conventionally there is known such an antenna unit as shown in FIG. 25. This antenna unit can be attracted to and held in the installation portion of a vehicle roof panel or the like as the need arises. And, the antenna unit includes a main body part 620 containing a case which is composed of a bottom cover 601 formed of zinc by die casting and a top cover 602 to be mounted on the bottom cover 601. Within the main body part 620, there are stored a circuit board 603 with a large number of electric parts assembled thereon, a metal shield cover 611 for covering the circuit board 603, an antenna main body 604 for receiving an electric wave from a stationary satellite, and the like.

Also, the bottom cover 601 includes a recessed portion formed in the bottom surface thereof. A back yoke 607 of a ferromagnetic substance to be fixed by a plurality of mounting screws 606 is disposed in the recessed portion. A ring-shaped magnet 608 for mounting is attracted to and held on the lower surface side of the back yoke 607, and the antenna unit can be attracted to and held in the installation portion thereof due to the magnetic force of the ring-shaped magnet 608.

And, in the present antenna unit, in order to prevent damage of the portion of the vehicle roof panel or the like on which the present antenna unit is installed, a flexible synthetic resin sheet 622 such as a polyurethane sheet or the like is bonded to the bottom surface of the main body part 620 (the lower surface of the bottom cover 611, ring-shaped magnet 608 and the like).

Therefore, the present antenna unit can be attracted to and held in its installation portion of the vehicle roof panel or the like due to the magnetic force of the ring-shaped magnet 608 with the synthetic resin sheet 622 in close contact with the installation portion.

As described above, in the conventional antenna unit of a type that the flexible synthetic resin sheet 622 such as a polyurethane sheet or the like is bonded to the bottom surface of the main body part 620, the existence of the synthetic resin sheet 622 protects the installation portion of the antenna unit in the roof panel or the like against damage, and the close contact of the synthetic resin sheet 622 with the roof panel or the like provides a relatively large slippage preventive force, so that the whole antenna unit can be held in a stable manner. On the other hand, however, in the summer glaring sunlight, the temperature of the vehicle roof panel or the like, on which the antenna unit is mounted, may increase up to a very high level due to the glaring sunlight and the synthetic resin sheet 622 bonded to the bottom surface of the main body part may melt and becomes adhered to the vehicle roof panel or the like. This may not only stain or damage the roof panel or the like but also may make it impossible to move or remove the antenna unit.

In view of the above, as shown in FIGS. 26 and 27, it is proposed that not only the synthetic resin sheet 622 is bonded to the bottom surface of the main body part 620 but also a heat resisting Polyethlyene Terephthalate ("PET") sheet 624 is bonded to the lower surface side of the central portion of the synthetic resin sheet 622. In this case, the PET sheet 624 situated in the central portion of the bottom surface of the main body part 620 comes into contact with the roof panel R, namely, the antenna unit installation portion. Also, since the PET sheet 624 is thin, part of the synthetic resin sheet 622 situated in the outer peripheral portion of the bottom surface of the main body part 620 also comes into contact with the roof panel locally.

In this structure, since the greater part of the contact portion of the synthetic resin sheet 622 with the installation portion such as the roof panel R or the like is covered with or occupied by the heat resisting PET sheet 624, there is eliminated the above-mentioned inconvenience that, due to the overheated installation portion such as a roof panel or the like, the synthetic resin sheet 622 melts and adheres to the roof panel or the like to thereby stain the same or make it impossible to move or remove the antenna unit.

However, in the above-mentioned structure, there is still left a problem to be solved. That is, not only can the PET sheet having a large contact area not provide a sufficient slippage preventive force but also the contact area of the flexible synthetic resin sheet 622 such as a polyurethane sheet having a large slippage preventive force is very small. Due to this, the antenna unit is easy to slip so that the antenna unit cannot be held stably in the installation portion such as the roof panel or the like.

As is generally known, a plane antenna for use in a global positioning system is magnetically attracted to and mounted on the metal roof panel of a vehicle in order to receive an electric wave from a man-made satellite for the GPS (global positioning system). A conventional plane antenna has such a structure as shown in FIG. 30.

As shown in FIG. 30, an antenna main body 701A, which includes an antenna element 701*a* and a circuit board 701*b* with accompanying circuit elements mounted thereon, is stored in a waterproof and dustproof resin case and is fixed to the surface of a roof panel X or the like, before it is used. That is, the resin case, which is formed by injection molding, includes a bottom cover 703A with a permanent magnet 702A assembled to the bottom surface thereof and, after the antenna main body 701A is assembled to the surface of the bottom cover 703A, the surface side of the bottom cover 703 is covered with a top cover 704A which is formed of resin similar to the case.

The antenna main body 701A stored in the resin case is susceptible to ambient electric fields and magnetic fields and, therefore, in order to prevent the influences of the ambient magnetic and electric fields from the roof panel X side, a conductive aluminum evaporated sheet 705A is bonded to the bottom surface of the bottom cover 703A to thereby prevent the antenna main body 701A from being adversely affected by the ambient magnetic and electric fields from the roof panel X side.

However, when such aluminum evaporated sheet 705A is used, the aluminum evaporated sheet 705A must be produced specially, which not only results in the relatively high production cost of the aluminum evaporated sheet 705A but also increases the assembling time necessary for bonding the aluminum evaporated sheet 705A.

As described above, the plane antenna for use in the global positioning system (GPS) receives an electric wave from a man-made satellite for GPS. And, since the plate antenna is sometimes mounted on the metal roof panel of a vehicle, the plate antenna is stored in a waterproof and dust proof resin case.

FIG. 35 shows such resin case which can be assembled by use of an assembling screw 806. An antenna main body 801, which is composed of an antenna element 801*a* and a circuit board 801*b* with accompanying circuit elements mounted thereon, includes a bottom cover 803 with a fixing permanent magnet 802 assembled to the bottom surface thereof. After the antenna main body 801 is assembled to the surface of the bottom cover 803, the surface side of the bottom cover 803 is covered with a top cover 804 which is similarly formed of resin, and the plane antenna can be fixed to the vehicle roof panel X or the like due to the magnetic force of the permanent magnet 802.

In the above-mentioned conventional resin case, since the antenna main body 801 must be protected completely from the outside world, a ring-shaped receiving seat 803*a* enclosing the outside of the antenna main body 801 is formed integrally with the surface of the bottom cover 803. A packing 805 to be seated on the ring-shaped receiving seat 803*a* is elastically deformed by a compression ring 804*a* provided in the top cover 804, whereby a space in which the antenna main body 801 is incorporated can be kept liquid tight.

According to the seal structure of the above plane antenna, there arises no serious problem when the bottom cover 803 and top cover 804 are strongly fixed together by use of the assembling screw. However, when the bottom cover 803 and top cover 804 are fixed together simply by means of locking claws and engaging claws for the purpose of simplification of the assembling process, it is difficult to hold the packing 805 in the compressed condition. Therefore a problem arises, if a higher waterproof level is required.

SUMMARY OF THE INVENTION

The present invention eliminates the drawbacks found in the above-mentioned conventional antenna unit for use in a navigation system. Accordingly, it is a first object of the invention to provide an antenna unit for use in a navigation system which can be assembled efficiently without using any tool or assembling screw.

It is a second object of the invention to provide an antenna unit for use in a navigation system in which a permanent magnet ring and a back yoke can be mounted onto an outer enclosure case without using any tool.

In attaining the above objects, according to the invention, there is provided an antenna unit for use in a navigation system in which the outside dimension of the bottom cover is smaller than the outside dimension of the unit case.

It is also another object of the invention to provide an antenna unit in which the root portion of a cable on the antenna unit side can be restrained effectively to thereby eliminate the possibility that the movement of the cable will effect a stabilizing shield plate used to stabilize the electric wave receiving condition.

It is another object of the invention to provide an antenna unit in which a bottom cover and a top cover can be assembled and fixed together simply and easily without using a screw, thus the number of parts can be reduced.

It is another object of the invention to provide an antenna unit in which a magnet with a back yoke can be simply mounted onto a bottom cover, thus the number of parts can be reduced, operations requiring time and labor such as a tapping operation, a hole machining operation and the like can be eliminated, the back yoke and magnet can be simplified in shape, and the manufacturing cost of the antenna unit can be reduced.

It is a further object of the invention to provide an antenna unit which can eliminate the inconvenience that, due to the overheated antenna unit installation portion of a roof panel or the like, a synthetic resin sheet bonded to the bottom surface of an antenna main body part may melt and adhere to the installation portion and thereby not only stain the roof panel or the like but also make it impossible to move and remove the antenna unit. The synthetic resin sheet provides a sufficient slippage preventive force and thus the antenna can be held stably at its installation portion.

It is another object of the invention to provide a plane antenna structure which can prevent an antenna main body from being affected adversely by ambient magnetic and electric fields.

It is still another object of the invention to provide a plane antenna which, in view of the problems found in the seal structure of above-mentioned conventional plane antenna, prevents rainwater and the like from invading between a bottom cover and a top cover even if the bottom and top covers are assembled together by use of simple assembling means.

In attaining the above object, according to the invention, there is provided an antenna unit for use in a navigation system in which a unit circuit board and an antenna main body are stored in an outer enclosure case composed of a bottom cover and a unit case, characterized in that a cylindrical storage part capable of storing therein the unit circuit board and antenna main body is formed integral with the surface of the bottom cover, a cylindrical joint part threadedly connectable with the cylindrical storage part is formed integral with the interior of the cup-shaped unit case, and the cylindrical joint part is threadedly connected to the cylindrical storage part.

Also, in attaining the above object, according to the invention, there is provided an antenna unit for use in a navigation system, in which the above-mentioned cylindrical storage part includes in the bottom surface thereof a recessed portion into which a permanent magnet and a back yoke can be positioned, the surface of the unit circuit board facing the recessed portion is covered with a shield case formed of a ferromagnetic substance, and the above antenna main body is fixed to the above bottom cover due to the magnetic force produced between the shield case and back yoke.

It is another object of the invention to provide an antenna unit for use in a navigation system which has an excellent waterproof structure. This object can be attained by providing a structure that a waterproof seal to be seated on the end face of the above cylindrical storage part or the above cylindrical joint part is used to seal the interior space of the above cylindrical storage part.

Also, it is still another object of the invention to provide an antenna unit for use in a navigation system which has a structure excellent in appearance.

In attaining the above object, according to the invention, there is provided an antenna unit which includes a case composed of a bottom cover and a top cover for storing therein a circuit board, an antenna main body and the like. And, in the antenna unit, a stabilizing shield plate for stabilizing the electric wave receiving condition is mounted on the lower surface of the bottom cover, and a draw-out opening for drawing out a cable connected to the above circuit board is formed in the top cover. The lower portion of the draw-out opening is cut away into a cutaway circular shape, and the width of the cutaway portion of the draw-out opening is smaller than the outside diameter of the cable.

In attaining the above object, according to the invention, there is provided an antenna unit which includes a case composed of a bottom cover and a top cover for storing therein a circuit board, an antenna main body and the like. The bottom cover includes a plurality of engaging wall portions which are positioned on the same circumference and each of the engaging wall portions includes a projecting strip which is slightly inclined in the vertical direction, while the top cover includes projections which can be fitted with the projecting strips by rotating the top cover at a proper angle while the top cover is being placed on the bottom cover.

In the antenna unit according to the invention, in order to prevent the bottom cover and top cover from being loosened after they are rotatively assembled together, there may be preferably provided a securing piece and a recessed portion with which the securing piece can be engaged. The bottom cover is made in such a manner that the bottom cover is smaller in an outer diameter than the unit case.

In attaining the above object, according to the invention, there is provided an antenna unit which includes a case composed of a bottom cover and a top cover for storing therein a circuit board, an antenna main body and the like. The bottom cover includes at a plurality of positions of the peripheral side portion thereof a plurality of insertion portions which are respectively opened laterally and include securing portions in the lower portions thereof. Magnets are respectively inserted into and held in the insertion portions while the magnets are attracted to the back yokes. That is, the magnets with the back yokes are inserted from laterally into the insertion portions with the securing portions provided on the peripheral side portion of the bottom cover.

In attaining the above object, according of the invention, there is provided an antenna unit of a type that a main body part for storing an antenna main body and a mounting magnet therein is attracted to and held in an installation portion, in which small-piece PET sheets are spaced from one another and bonded to two or more portions of the outer periphery of the bottom surface of the main body part, a synthetic resin sheet is bonded so as to cover the bottom surface of the main body part on the lower surface side thereof, and a PET sheet is bonded to the lower surface side of the central portion of the synthetic resin sheet where the small-piece PET sheets are not bonded.

In achieving this object, according to the invention, there is proposed a plane antenna of a type that an antenna element and a circuit board with accompanying circuit elements mounted thereon are stored in a resin case composed of a bottom cover and a top cover for covering the surface of the bottom cover, in which the bottom cover is formed of material which consists of resin mixed with aluminum powder.

In achieving this object, according to the invention, there is proposed a plane antenna of a type that an antenna element and a circuit board with accompanying circuit elements mounted thereon are stored in a resin case composed of a bottom cover and a top cover for covering the surface of the bottom cover, in which a waterproof sheet is provided in such a manner that it covers at least the opening of the storage space of the bottom cover for storing the antenna element and circuit board therein.

According to the invention, there is provided a structure in which the bottom cover includes a seat portion for seating a packing thereon and, in a storage space in the central portion thereof, a storage cylinder into which the antenna element and circuit board can be positioned, the top cover includes a cylindrical projection which can press the packing against the seat portion, the waterproof sheet has an area to cover the surface of the seat portion, and the waterproof sheet is provided between the bottom cover and top cover due to connection of engaging claws formed in the cylindrical projection that are engageable with locking claws formed in the outer peripheral surface of the storage cylinder.

Also, according to the invention, there is provided a structure in which the bottom cover includes, in a storing space in the central portion thereof, a storage cylinder into which the antenna element and circuit board can be positioned, and the waterproof sheet has an area corresponding to the opening surface of the storage cylinder and is attached to the same opening surface.

Further, according to the invention, there is provided a plane antenna which can be produced by assembling a bottom cover and a top cover to each other by use of assembling screws, in which the bottom cover includes, in a storage space in the central portion thereof, a storage cylinder into which the above antenna element and circuit board can be positioned, a sealing groove capable of storing an O ring is formed in the outer periphery base portion of the storage cylinder, and the top cover is assembled to the bottom cover in such a manner that the outer periphery of the waterproof sheet is secured to the sealing groove by means of the O ring.

As can be seen clearly from the foregoing description, according to the invention, not only can there be obtained an antenna unit structure which can be assembled at a low manufacturing cost without using assembling screws, fixing screws and any tool, but also there can be provided an efficient assembling process in which the unit case is simply screwed to the bottom cover.

In the antenna unit according to the invention structured in the above-mentioned manner, the root portion of the cable is pushed into the draw-out opening formed in the top cover through the cutaway portion of the draw-out opening, whereby the cable is restrained and fixed to the antenna unit.

For this reason, even if the portion of the cable showing externally out of the antenna unit is pulled back slightly or is swung right and left slightly, the movement of the cable portion is stopped by the restrained and fixed draw-out portion and is not transmitted to the stabilizing shield plate, with the result that the stabilizing shield plate cannot be detached from the bottom cover and thus there can be obtained an effective product.

In the antenna unit according to the invention structured in the above-mentioned manner, when assembling and fixing the top cover to the bottom cover, with the top cover being put on the bottom cover, the top cover is rotated at a proper angle, for example, clockwise in a plan view with respect to the bottom cover.

As a result, the projection provided in the top cover is fitted with the inclined projecting strip of the engaging wall portion provided in the bottom cover, whereby the top cover is assembled to the bottom cover.

Also, if a securing piece and a recessed portion with which the securing piece can be engaged are respectively formed in the bottom cover and top cover, then the bottom cover and top cover are prevented from loosening after they are rotatively assembled together, which makes it sure that the top cover can be fixed to and held on the bottom cover.

In the antenna unit according to the invention structured in the above-mentioned manner, when mounting the back yoke and magnet onto the bottom cover, for example, the magnet is previously attached to and held by the back yoke due to the magnetic force thereof and is fixed thereto by use of an adhesive or the like, and the magnet with the back yoke is inserted laterally into the insertion portion with a securing portion formed in the peripheral side portion of the bottom cover.

As described above, in the antenna unit according to the invention, since the magnet with the back yoke may be simply inserted into the insertion portion of the bottom cover, the magnet with the back yoke can be mounted onto the bottom cover simply and easily. Also, since no screw is used, the number of parts can be reduced and there can be eliminated operations requiring time and labor such as a tapping operation, a hole machining operation and the like, and the shapes of the back yoke and magnet can be simplified.

In the antenna unit according to the invention structured in the above-mentioned manner, a plurality of small-piece PET sheets are spaced apart from one another and are bonded to the portion between the bottom surface of the main body part and synthetic resin sheet, that is, the outer peripheral portion of the synthetic resin sheet on the upper surface side thereof and a PET sheet is bonded to the central portion of the synthetic resin on the lower surface side thereof. Due to this, when the antenna unit is attracted to and held in the installation portion, not only the PET sheet bonded to the above central portion comes into contact with the installation portion, but also the lower side portion (back surface portion) of the synthetic resin sheet where the small-piece PET sheets are situated come into contact with the installation portion.

Therefore, since the contact area of the synthetic resin sheet is increased when compared with a case where no small-piece PET sheet is used, the antenna unit does not slip and thus the antenna unit can be held stably in the installation portion. Also, since the contact portion of the synthetic resin sheet is limited to the back side portions of the small-piece PET sheets, there can be effectively eliminated the inconvenience that, due to the overheated installation portion, the synthetic resin sheet bonded to the bottom surface of the main body part can melt and adhere to the installation portion and thereby stain the installation portion and make it impossible to move and remove the antenna unit.

As can be understood clearly from the foregoing description, according to the invention, since the bottom cover is formed of resin mixed with aluminum powder, the periphery of the antenna main body except for the antenna element can be completely shielded from the external electric and magnetic fields even without using an aluminum evaporated sheet. Therefore, according to the invention, there can be provided a plane antenna which eliminates the use of the aluminum evaporated sheet which reduces the number of parts as well as simplifies the assembling process thereof.

As can be seen clearly from the foregoing description, according to the invention, since the waterproof sheet is spread between the bottom cover and top cover cooperating together in forming the resin case, even in a plane antenna in which the bottom cover and top cover cannot be fixed together strongly due to the simplified assembling process, the storing space for storing the antenna main body therein can be sealed perfectly. This prevents the early deterioration of the antenna main body due to rainwater or the like so that the plane antenna has a long life.

DETAILED DESCRIPTION Of THE PREFERRED EMBODIMENTS

First and second embodiments

Now, description will be given below in detail of first and second embodiments of an antenna unit for use in a navigation system according to the invention with reference to FIGS. 1 to 3.

Figure 1:
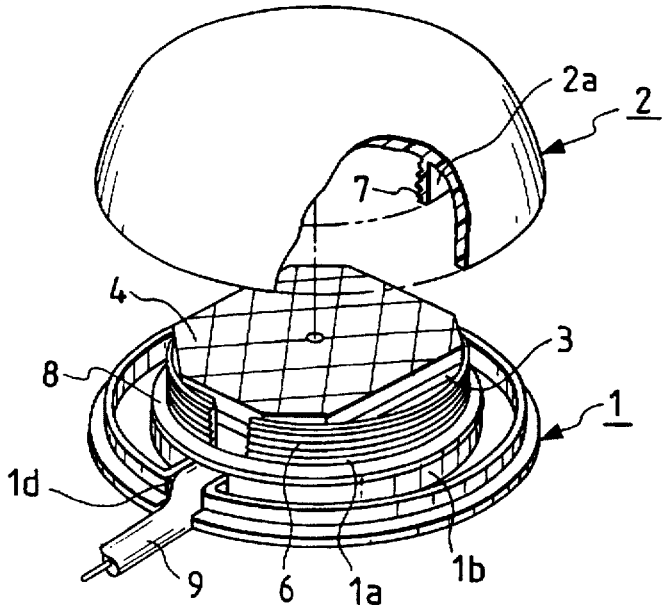
FIG. 1 is a partially cutaway exploded perspective view of a first embodiment of an antenna unit for use in a navigation system according to the invention.
Figure 2:
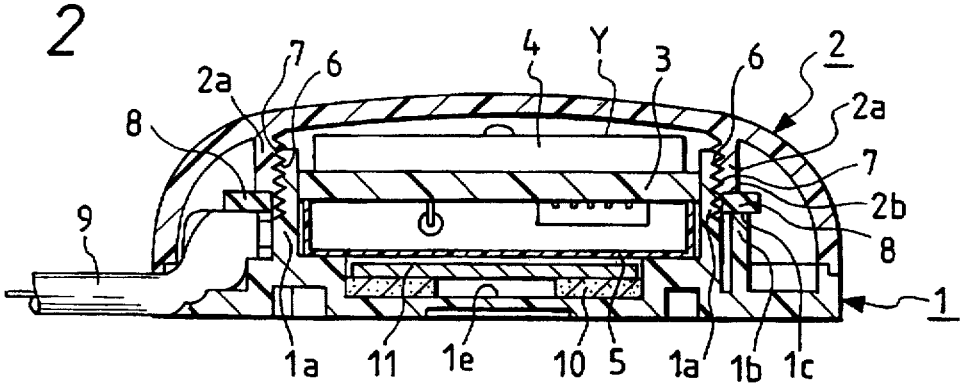
FIG. 2 is a vertical section view of the antenna unit shown FIG. 1.

FIGS. 1 and 2 show an antenna unit according to a first embodiment of the invention. The present antenna unit includes an outer enclosure case which comprises a bottom cover 1 and a unit case 2, while the bottom cover 1 is formed of resin into a substantially circular plate and the unit case 2 is formed of resin into a circular cup having the same outer shape as the bottom cover 1. And, within the bottom cover 1 and unit case 2, there are assembled a unit circuit board 3 and an antenna main body 4. That is, on the surface of the bottom cover 1, a cylindrical storage portion la, the lower surface of which is covered with a shield case 5 formed of a ferromagnetic substance and into which the unit circuit board 3 and antenna main body 4 can be stored, and a seal receiving portion 1*b* enclosing the outer periphery of the cylindrical storage portion 1*a* are formed integrally therewith, while the cylindrical storage portion 1*a* includes a male screw 6 formed on the outer peripheral surface of the leading end portion of the cylindrical storage portion.

Also, on the lower surface of the unit case 2, there is formed integrally therewith a cylindrical joint portion 2*a* having an inside diameter slightly smaller than the outer shape of the cylindrical storage portion 1*a* and, on the leading end inner peripheral surface of the cylindrical joint portion 2*a*, there is formed a female screw 7 which is engageable with the male screw 6. And, a ring-shaped waterproof seal 8 is seated between the leading end face 2*b* of the cylindrical joint portion 2*a* and the end face 1*c* of the seal receiving portion 1*b* and, therefore, simply by tightening the female screw 7 with respect to the male screw 6, the internal space Y of the cylindrical storage portion 1*a* can be shielded from the outside by the waterproof seal 8.

However, the relation between the cylindrical storage portion 1*a* of the bottom cover and the cylindrical joint portion 2*a* of the unit case 2 is not limited to the above-mentioned structure but, alternatively, the inside diameter dimension of the cylindrical storage portion 1*a* may be set larger than the outer shape dimension of the cylindrical joint portion 2*a*, and a female screw may be formed in the cylindrical storage portion 1*a* while a male screw may be formed in the cylindrical storage portion 2*a*.

For connection of the present antenna unit with a navigation system (which is not shown), an antenna cord 9 is connected to the unit circuit board 3 and, in particular, the antenna cord 9 is disposed in a connection hole 1*d* formed in part of the outer periphery of the bottom cover 1.

In the bottom surface of the above-mentioned cylindrical storage portion 1*a*, there is formed a recessed portion 1*e* into which a permanent magnet ring 10 and a circular back yoke 11 respectively used to attract the antenna unit to a vehicle roof panel or the like can be positioned. Simply by fixing the permanent magnet ring 10 to the surface of the recessed portion 1*e* with an adhesive, the shield case 5, unit circuit board 3 and antenna main body 4 can be held naturally on the bottom cover 1 due to the magnetic forces of the permanent magnetic ring 10 and back yoke 11 without using any fixing means.

Since the antenna unit according to the first embodiment of the invention has the above-mentioned structure, the antenna unit can be assembled without using any tool. That is, if the permanent magnet ring 10 is fixed to the recessed portion 1*e* of the bottom cover 1 with an adhesive and the back yoke 11 and unit circuit board 3 are placed on the permanent magnet ring 10, then the back yoke 11 and unit circuit board 3 can be held in the internal space Y of the cylindrical storage portion 1*a* due only to the magnetic force of the permanent magnet ring 10.

Therefore, after the antenna cord 9 is arranged in the connection hole 1*d* of the bottom cover 1 and the waterproof seal 8 is located on the end face of the seal receiving portion 1*b*, if the cylindrical joint portion 2*a* of the unit case 2 is applied to the cylindrical storage portion 1*a* of the bottom cover 1 and the unit case 2 is rotated with respect to the bottom cover 1, then the antenna unit can be assembled in such a manner as shown in FIG. 2.

In this assembled state, since the waterproof seal 8 is tightened between the seal receiving portion 1*b* and the leading end face of the unit case 2, the internal space Y of the cylindrical storage portion 1*a* can be kept liquid tight. Thanks to this, according to the structure of the first embodiment of the invention, assembling screws and fixing screws can be omitted to thereby reduce the costs of the parts required as well as the antenna unit can be assembled efficiently.

Of course, it goes without saying that the antenna unit according to the first embodiment of the invention can be attracted to a vehicle roof panel (now shown) due to the magnetic force of the permanent magnet ring 10.

Second embodiment

Figure 3:
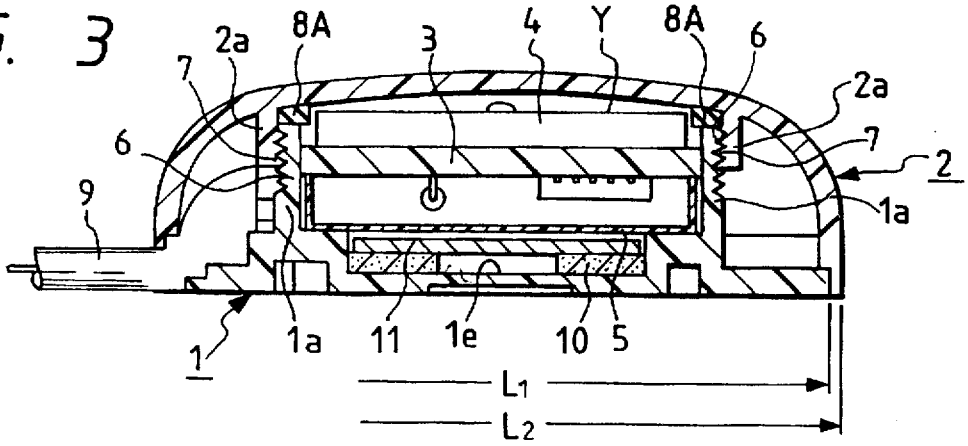
FIG. 3 is a vertical section view of a second embodiment of an antenna unit according to the invention.
Figure 4:
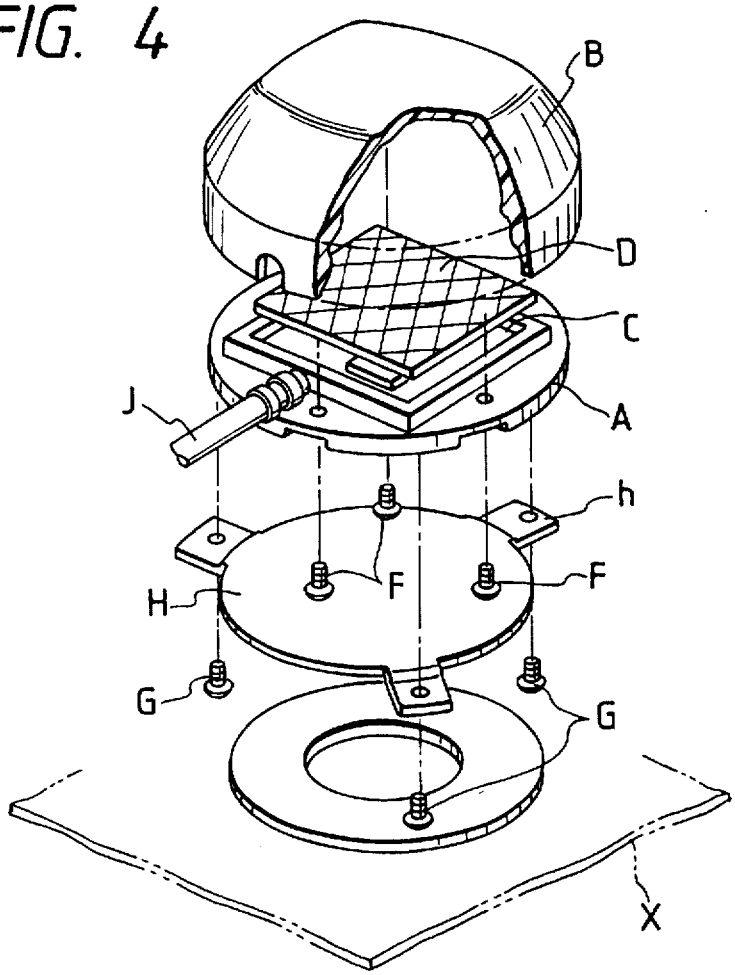
FIG. 4 is a partially cutaway exploded perspective view of a conventional antenna unit for use in a navigation system.
Figure 5:
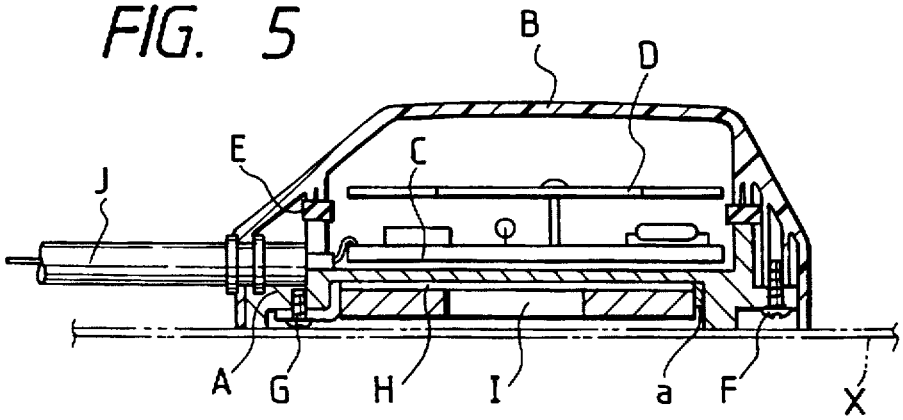
FIG. 5 is a vertical section view of the conventional antenna unit shown in FIG. 4.

FIG. 3 is a section view of an antenna unit according to a second embodiment of the invention, and corresponds to FIG. 2, in which the same structural parts thereof as in the first embodiment are given the same designations.

The antenna unit according to the second embodiment is characterized in that the outer shape dimension $L_2$ of the unit case 2 is set larger than the outer shape dimension $L_1$ of the bottom cover 1 and a waterproof seal 8A is seated on the cylindrical storage portion 1*a* of the bottom cover 1.

In the structure of the antenna unit according to the second embodiment, since the bottom cover 1 is assembled in such a manner that it is hidden in the interior of the unit case 2, the appearance of the antenna unit is improved when it is viewed from side. As the leading end portion thereof is interposed between the cylindrical storage portion 1*a* of the bottom cover 1 and the bottom surface 2*b* of the unit case 2, simply by screwing the cylindrical joint portion 2*a* into the cylindrical storage portion 1*a* of the bottom cover 1, the internal space Y of the cylindrical storage portion 1*a* can be sealed only by the waterproof seal 8A.

As can be seen clearly from the above description, according to the first and second embodiments of the invention, not only there can be obtained an antenna unit structure which eliminates the use of the assembling screws and fixing screws and can be assembled at the relatively low manufacturing cost without using any tools, but also there can be provided an efficiently assembling process which can be achieved by only screwing the unit case into the bottom cover.

Third embodiment

Next, description will be given below of a third embodiment of an antenna unit according to the invention with reference to FIGS. 6 to 8.

Figure 6:
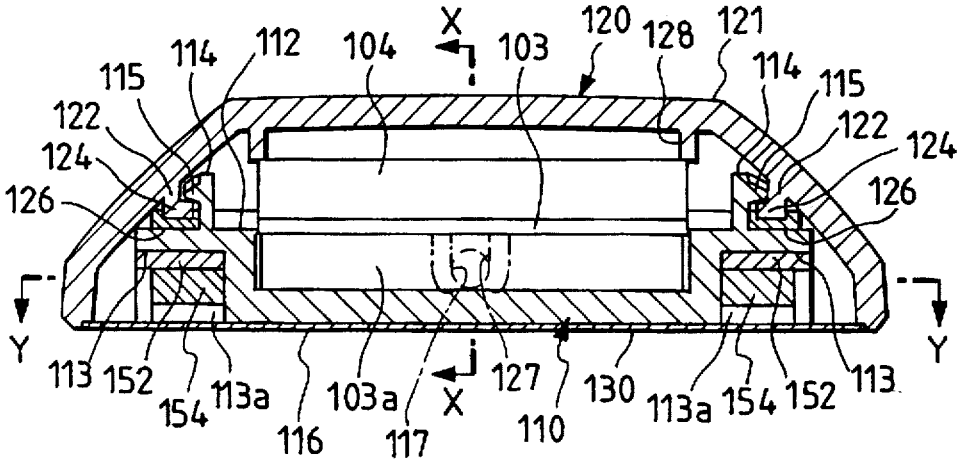
FIG. 6 is a centrally longitudinal section view of a third embodiment of an antenna unit according to the invention.
Figure 7:
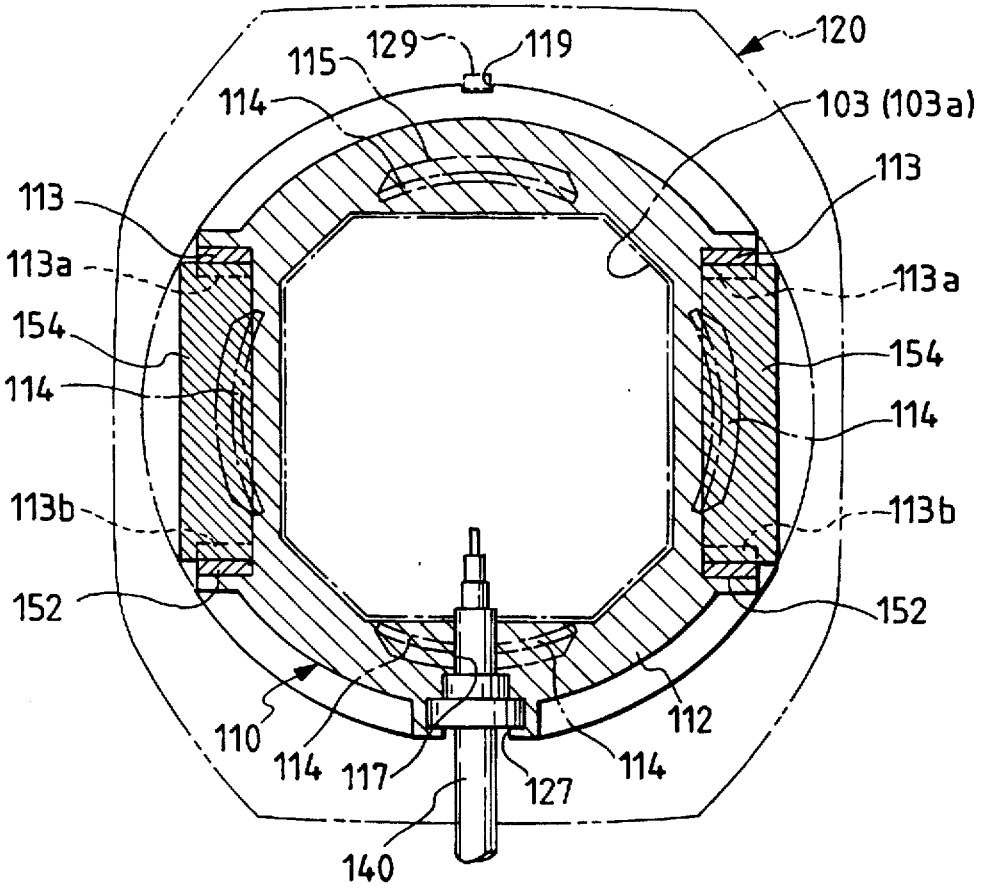
FIG. 7 is a section view taken along the Y—Y line shown in FIG. 6, with a top cover omitted therefrom.
Figure 8:
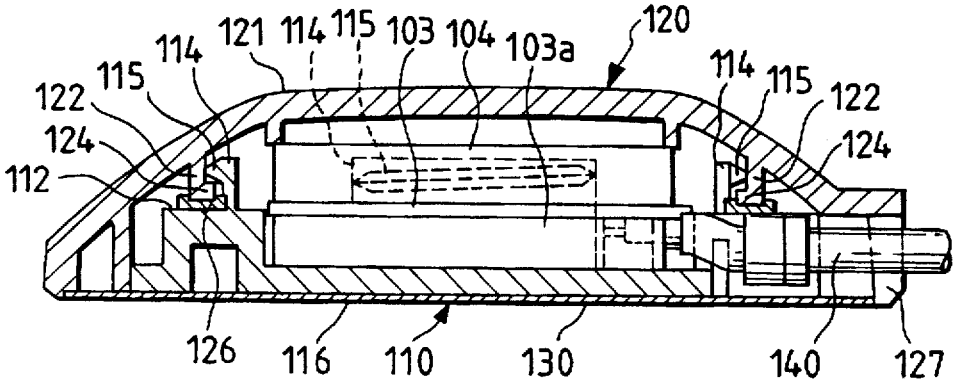
FIG 8. is a section view taken along the X—X line shown in FIG. 6.

FIGS. 6 to 8 are respectively sectional views of the third embodiment of an antenna unit according to the invention.

The antenna unit shown in FIGS. 6 to 8, similarly to the before-described conventional antenna unit, is structured such that it can be attracted to and held on the installation portion such as a vehicle roof panel or the like as the need arises. The present antenna unit includes a case which comprises a bottom cover 110 formed of resin and a top cover 120 to be placed on the bottom cover 110. And, in the case, there are stored a circuit board 103 with a large number of electronic parts assembled thereto, a shield cover 103*a* formed of metal for covering the circuit board 103, an antenna main body 104 for receiving an electric wave from a stationary satellite, and the like.

The bottom cover 110, as shown in FIG. 6 and FIGS. 11 to 13 as well, includes a circular bottom plate portion 116, a ring-shaped portion 112 superposed on the bottom plate portion 116 in parallel thereto, four engaging wall portions 114, 114, 114, 114 (114A, 114B) respectively formed at the right and left as well as front and rear positions on the same circumference in such a manner that they are spaced from one another at regular angle intervals (at 90° intervals) along the peripheral direction, and four projecting strips 115, 115, 115, 115 (115A, 115B) respectively formed on the outer peripheral surface side of the four engaging wall portions 114, 114, 114, 114 (114A, 114B) in such a manner that they are slightly inclined in the vertical direction thereof and also that they respectively have a triangular section. The two end portions of each of the projecting strips 115, 115, 115, 115 are respectively sharpened in a conical shape.

Figure 12:
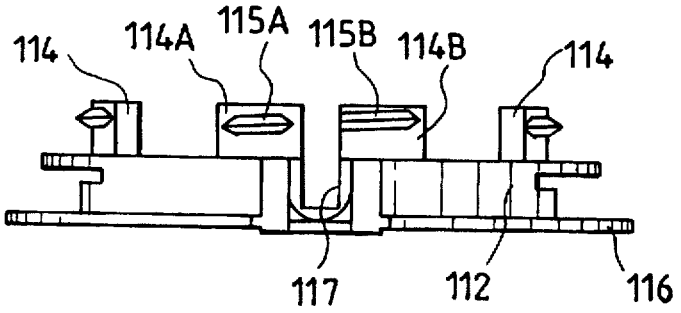
FIG. 12 is a side view of the bottom cover shown in FIG. 10.
Figure 13:
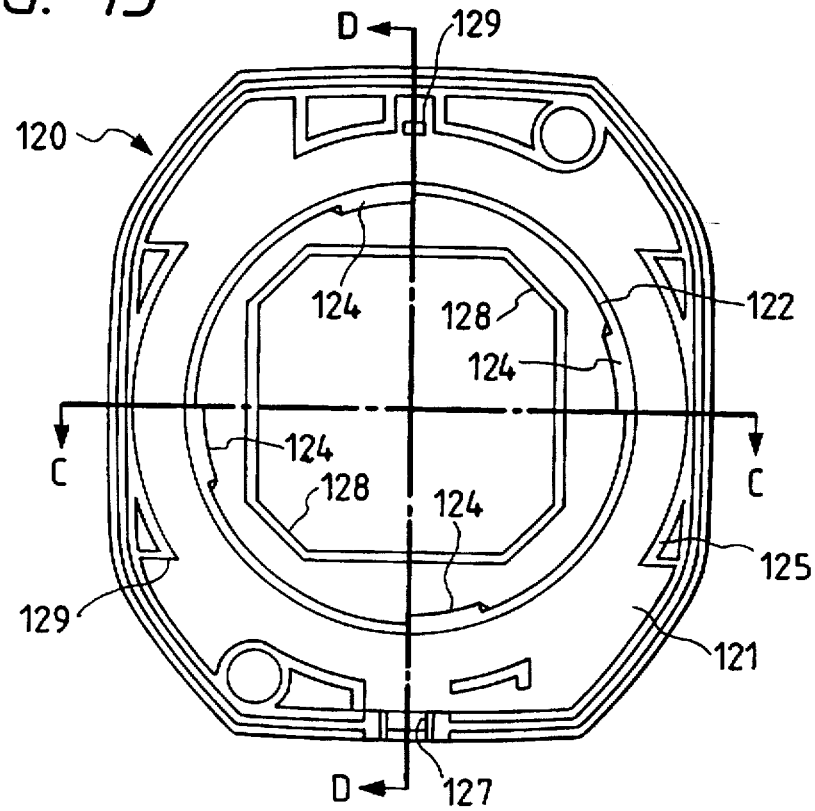
FIG. 13 is a bottom plan view of a top cover employed in the embodiment shown in FIG. 6.

In FIG. 12 the back side engaging wall portion 114, among the above-mentioned four right, left, front and back engaging wall portions 114, is divided into two wall portions 114A and 114B which are spaced a given distance from each other so as to be able to draw out a cable 140. And, on the outer peripheral surface side of the wall portions 114A and 114B, there are formed projecting strips 115A and 115B which are similarly formed by dividing the back-side projecting strip 115.

Also, in the position of the ring-shaped portion 112 that is situated in the lower portion of the distance between the two wall portions 114A and 114B, there is formed an inside draw-out opening 117 which is used to draw out the cable 140.

Figure 17:
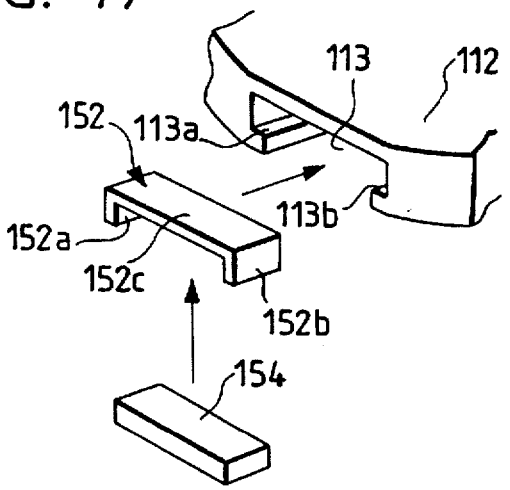
FIG. 17 is an exploded perspective view of an insertion portion formed in a bottom cover shown in FIG. 6 and a back yoke and a magnet to be inserted into the insertion portion.

And, at the two right and left portions of the annularly projected peripheral side portion 112 of the bottom cover 110, as can be seen well from FIG. 6 and FIG. 17, there are formed two mutually opposing insertion portions 113 and 113 which are respectively open toward a side and include a pair of securing projection piece portions 113*a* and 113*b* in the lower portions thereof. Also, two magnets 154 respectively including back yokes 152 are inserted into and held in the two insertion portions 113 and 113, respectively.

The back yoke 152 has a U-like shape and includes a long side portion 152*c* and two short side portions 152*a* and 152*b* respectively hanging down from the two ends of the long side portion 152*c* and, if a magnet 154 having a rectangular parallel pipe shape is mounted into a space defined by the respective side portions 152*a*, 152*b*, 152*c* of the back yoke 152, then the magnet 154 can be attracted to the yoke 152 due to the magnetic force thereof. Alternatively, the magnet 154 may be fixed to the back yoke 152 by use of an adhesive or the like.

With the magnet 154 attracted to and held in the back yoke 152, if the magnet 154 with the back yoke 152 is inserted to the insertion portion 131, then the short side portions 152*a* and 152*b* of the back yoke 152 are secured to the securing projection piece portions 113*a* and 113*b* of the insertion portion 131, so that the magnet 154 with the back yoke 152 can be inserted into and held in the insertion portion 113.

Figure 14:
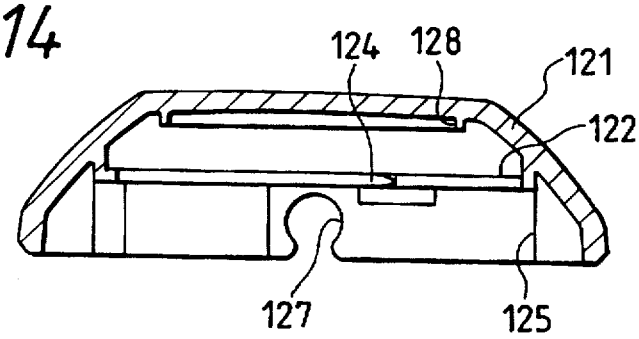
FIG. 14 is section view of the top cover shown in FIG. 13, taken along the line C—C shown in FIG. 13.
Figure 15:
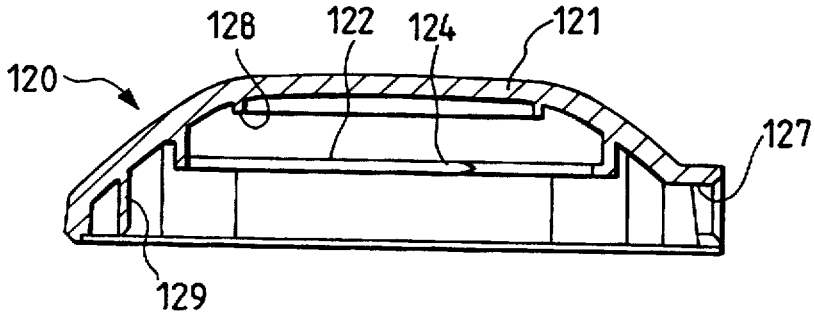
FIG. 15 is a section view of the top cover shown in FIG. 13, taken along the line D—D shown in FIG. 13.

On the other hand, the top cover 120, as shown in FIGS. 14 to 15 as well, includes a substantially hemispherical cover portion 121 and a ring-shaped portion 122 which is disposed in the cover portion 121 in such a manner that it projects downwardly. And, on the inner peripheral side of the ring-shaped portion 122 there are formed four strip-shaped projections 124, 124, 124, 124 which are very similar in shape to the projecting strips 115, 115, 115, 115 and spaced apart from one another at regular angle intervals (90° intervals) and also which can be fitted with the projecting strips 115, 115, 115, 115 by rotating the top cover 120 a proper angle (here, 40° to 50°) while the top cover 120 is being placed on the bottom cover 110. Also, in the bottom surface portion of the cover portion 121, there are properly formed projecting portions 128 and engaging projection portions 125 engageable with the bottom cover 110. The upper peripheral edge of the antenna main body 104 can be secured by the lower surfaces of the projecting portions 128.

And, in order to prevent the bottom cover 110 and top cover 120 from loosening after they are assembled together, the top cover 120 includes a sharp-pointed securing piece 129 of a rectangular section which hangs down from the front portion of the cover portion 121, while the bottom cover 110 includes in the front end edge portion thereof a recessed portion 119 FIG. 7 with which the securing piece 129 of the top cover 120 can be engaged.

Figure 16:
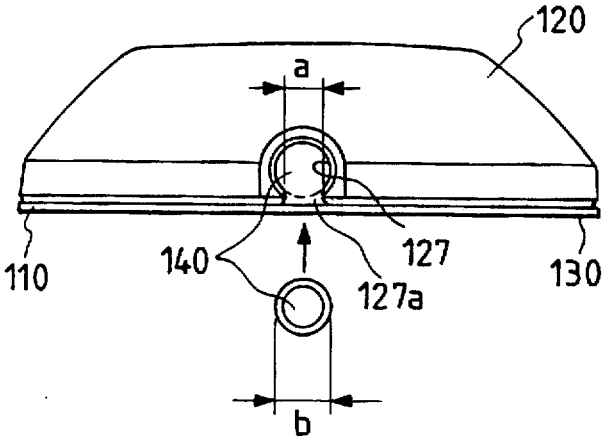
FIG. 16 is a side view of the top cover shown in FIG. 13.

Also, on the rear portion side of the cover portion 121, as can be seen clearly from FIG. 16, there is formed a draw-out opening 127 for drawing out the cable. The draw-out opening 127 includes a lower portion which is cut away to form a cutaway circular shape, and the width a of the cutaway portion 127*a* of the draw-out portion 127 is set smaller than the outside diameter b of the cable 140.

Figure 9:
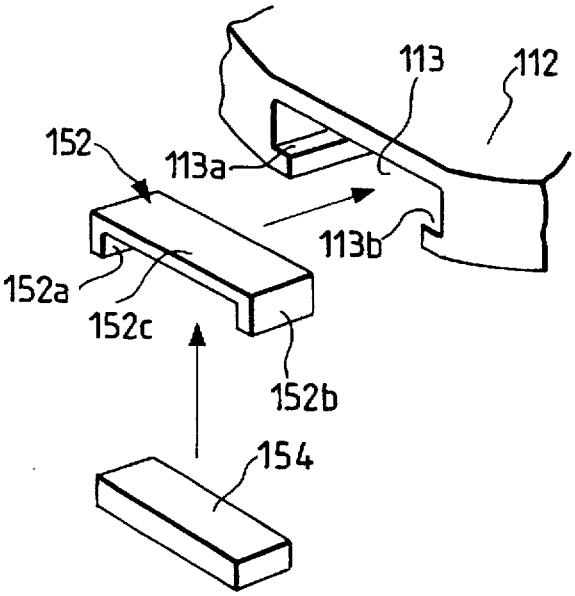
FIG. 9 is an exploded perspective view of an insertion portion formed in a bottom cover shown in FIG. 6 and a back yoke and a magnet to be inserted into the insertion portion.
Figure 10:
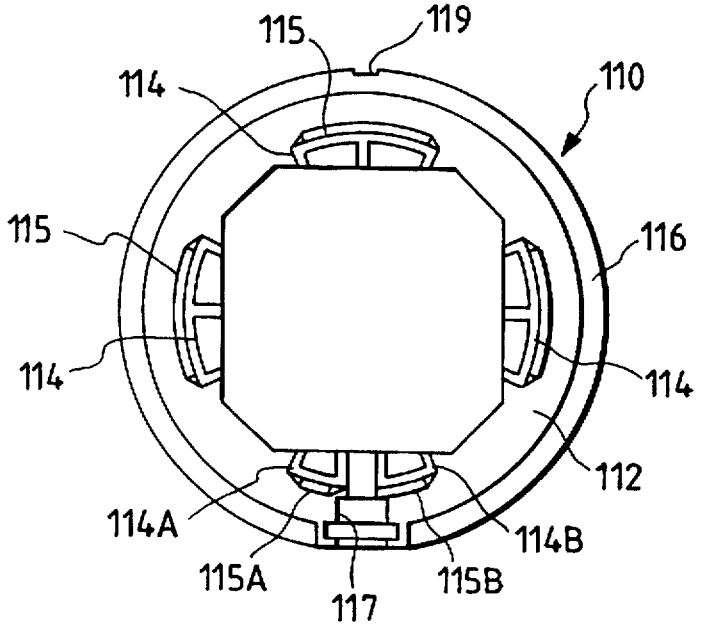
FIG 10 is a plan view of a bottom cover employed in the embodiment shown in FIG. 6.
Figure 11:
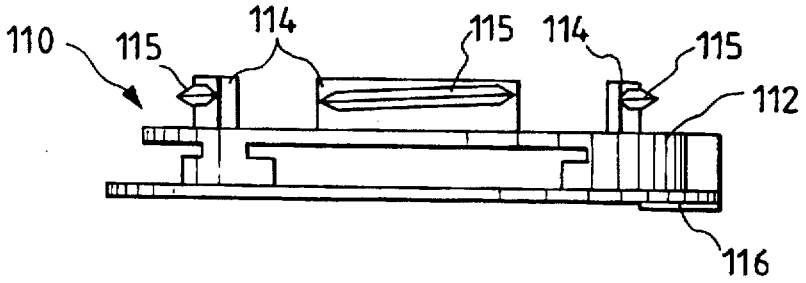
FIG. 11 is a side view of the bottom cover shown in FIG. 10.

Further, on the two right and left portions of the annularly projecting peripheral side portion 112 of the bottom cover 110, as can be seen clearly from FIGS. 9 and 17 in addition to FIG. 11, there are formed two mutually opposing insertion portions 113 and 113 which are respectively open to the side and include a pair of securing projection piece portions 113*a* and 113*b* in the lower portions thereof. And, the magnets 154 with the back yoke are inserted into and held in the insertion portions 131 and 131, respectively.

That is, the back yoke 152 is formed in a U shape which is composed of the long side portion 152*c* and two short side portions 152*a* and 152*b* respectively hanging down from the two ends of the long side portion 152*c* and, if the magnet 154 having a rectangular parallel pipe shape is mounted into a space defined by the side portions 152*a*, 152*b* and 152*c* of the back yoke 152, then the magnet 154 is attracted to and held in the space due to the magnetic force thereof. Alternatively, the magnet 154 may be fixed to the back yoke 152 by use of an adhesive or the like.

In the antenna unit according to the present embodiment and structured in the above manner, to assemble and fix the top cover 120 to the bottom cover 110, in a state in which the cable 140 is suspended down from the bottom cover 110, while the bottom cover 110 is being fitted into the top cover 120, the bottom cover 110 is rotated clockwise at a proper angle in the range of 40° to 50° with respect to the top cover 120.

As a result of this, the projections 124 formed in the top cover 120 are fitted with the inclined projection strips 115 of the engaging wall portions 114 formed in the bottom cover 110, whereby the top cover 120 is assembled to the bottom cover 110. In this operation, a waterproof packing rubber 126 is interposed between the projections 124 and the upper surface of the bottom cover 110, so that the bottom cover 110 and top cover 120 can be assembled together tightly.

Also, since the bottom cover 110 and top cover 120 respectively include the securing piece 119 and recessed portion 129 engageable with the securing piece 119, they are prevented from loosening after they are rotatively assembled together, which assures that the top cover can be fixed and held to the bottom cover.

Due to this, the top cover 120 can be assembled and fixed to the bottom cover 110 simply and easily without using any screw, which makes it possible to reduce the number of parts.

And, after the top cover 120 is assembled and fixed to the bottom cover 110, if the root portion of the hanging-down cable 140 is pushed into the draw-out opening 127 through the cutaway portion 127*a*, then the cable 140 can be restrained by and fixed to the top cover 120 of the antenna unit.

Therefore, even if the portion of the cable 140 showing externally of the antenna unit is slightly pulled backwardly or is slightly swung right and left, the movement of the cable 40 portion is blocked and stopped by the cutaway portion 127*a* of the draw-out opening 127 and thus the movement of the cable 40 is not transmitted to the stabilizing shield plate 130, which prevents the stabilizing shield plate 130 from being detached from the lower surface of the bottom cover 110.

Also, on the lower surface side of the bottom cover 110, as the need arises, there is mounted the stabilizing shield plate 130 formed of plate metal for stabilizing the electric wave receiving condition, and the antenna unit can be attracted to and held in the installation portion (such as a vehicle roof panel or the like) due to the magnetic force of the magnet 154.

In addition to the above, in the antenna unit according to the present embodiment, as described above, when mounting the back yoke 152 and magnet 154 onto the bottom cover 110, for example, the magnet 154 is previously attracted to and held against the back yoke 152 due to magnetic force and/or is fixed thereto by use of an adhesive or the like, and the magnet 154 with the back yoke 152 is inserted from side into the insertion portion 113 which is formed on the peripheral side portion 112 of the bottom cover 110 and includes the two securing projection piece portions 113*a* and 113*b*.

In this manner, according to the present embodiment, since the magnet 154 with the back yoke 152 may only be inserted into the insertion portion 113 of the bottom cover 110, the magnet 154 with the back yoke 152 can be mounted onto the bottom cover 110 simply and easily. And, because no screw is used, the number of parts can be reduced, there can be eliminated operations requiring time and labor such as a tapping operation, a hole machining operation and the like, and the shapes of the back yoke and magnet can be simplified.

Figure 18:
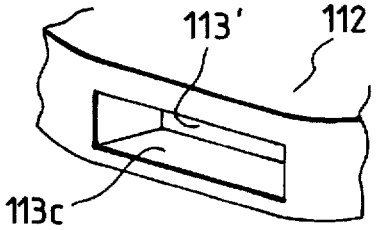
FIG. 18 is a perspective view of another embodiment of an insertion portion to be formed in the bottom cover.
Figure 19:
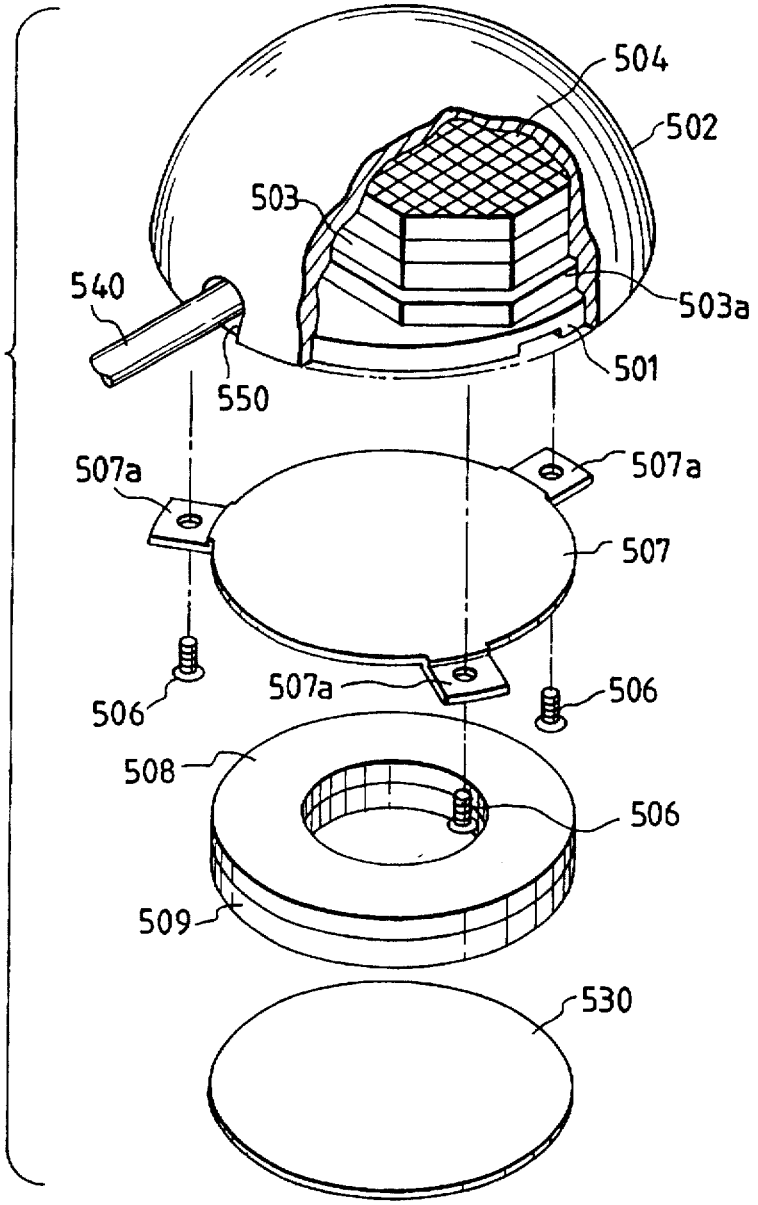
FIG. 19 is an exploded perspective view of an example of a conventional antenna unit.
Figure 20:
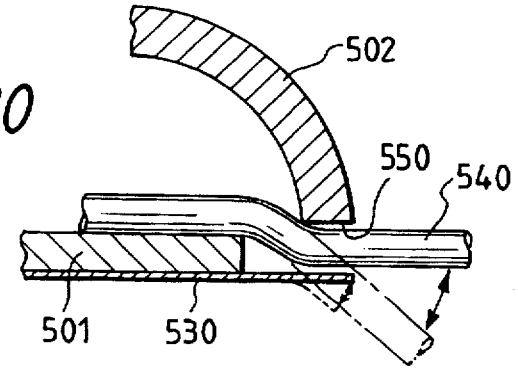
FIG. 20 is a partially enlarged section view used to explain how a cable fits in the conventional antenna unit shown in FIG. 19.

As for the structure of the insertion portion into which the magnet 154 with the back yoke 152 can be inserted, besides the structure with the above-mentioned securing projection piece portions 113*a* and 113*b*, for example, as shown in FIG. 18, there can be employed a bag-shaped structure 113' and, in this case, the low side portion 113*c* thereof serves as 25 the securing portion.

Further, if the insertion portion 113 into which the magnet 154 with the back yoke 152 can be inserted is structured such that it becomes slightly narrower toward the front side of the insertion direction of the magnet 154, then the magnet 154 with the back yoke 152 can be pressure attached and held more tightly as it is inserted, so that the magnet 154 with the back yoke 152 can be mounted onto the bottom cover 110 simply and easily without being loose.

As can be understood from the above description, in the antenna unit according to the invention, the bottom cover and top cover can be assembled and fixed together simply and easily without using any screw, and thus the number of parts can be reduced.

Also, as can be understood from the above description, in the antenna unit according to the invention, the root portion of the cable can be restrained effectively and thus the movement of the external portion of the cable will not be transmitted to the stabilizing shield plate, which prevents the bottom cover and stabilizing shield plate from being detached from each other by the cable.

Further, as can be understood from the above description, in the antenna unit according to the invention, since the magnet with the back yoke may simply be inserted into the insertion portion formed in the bottom cover, the magnet with the back yoke can be mounted onto the bottom cover simply and easily and, because no screw is used, the number of parts can be reduced, there can be eliminated operations requiring time and labor such as a tapping operation, a hole machining operation and the like, and the shapes of the back yoke and magnet can be simplified.

Fourth embodiment

Figure 21:
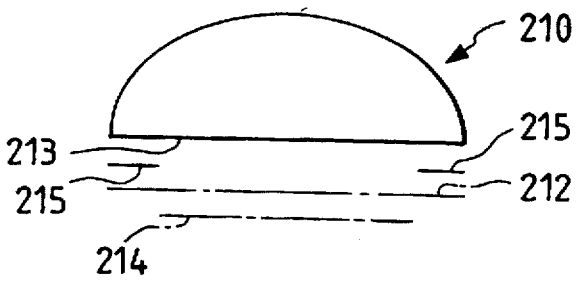
FIG. 21 is an illustration used to explain a fourth embodiment of an antenna unit according to the invention.

Now, description will be given below of a fourth embodiment of an antenna unit according to the invention with reference to FIGS. 21 to 23. That is, FIGS. 21 to 23 respectively show an antenna unit according to the fourth embodiment of the invention.

The antenna unit according to the present embodiment, includes a main body part 210 which is rectangular when it is viewed from the bottom surface (see FIG. 23) and also which stores therein a circuit board, an antenna main body, a mounting magnet and the like. Also, the main body part 210 of the antenna unit can be attracted to and held on the installation portion such as vehicle roof panel or the like.

And, four small-piece Polyethylene Terephthalate sheets 215, 215, 215, 215 are spaced apart from one another and bonded to the neighboring portions of the four corners of the outer periphery of the rectangular bottom surface 213 of the main body part 210, a flexible synthetic resin sheet 212 such as a polyurethane sheet or the like which is substantially the same in dimensions and shape as the rectangular bottom surface 213 is bonded to the lower surface side of the small-piece PET sheets 215, and a rectangular PET sheet 214 is bonded to the lower surface side of the central portion of the synthetic resin sheet 212 to which the small-piece PET sheets are not bonded.

In the antenna unit according to the present embodiment, the four small-piece PET sheets 215, 215, 215, 215 are spaced apart from one another and are bonded between the bottom surface 213 of the main body part 210 and the flexible synthetic resin sheet 212 such as a polyurethane sheet or the like, that is, to the outer peripheral portion of the synthetic resin sheet 212 on the upper surface side thereof, and the PET sheet 214 is bonded to the central portion of the synthetic resin sheet 212 on the lower surface side thereof.

Figure 22:
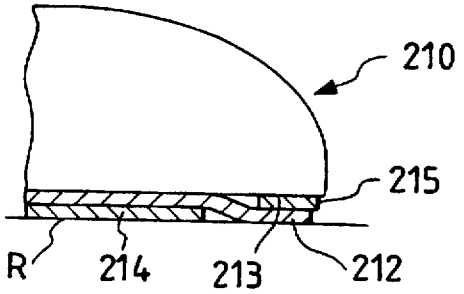
FIG. 22 is a partially enlarged view of the embodiment shown in FIG. 21.
Figure 23:
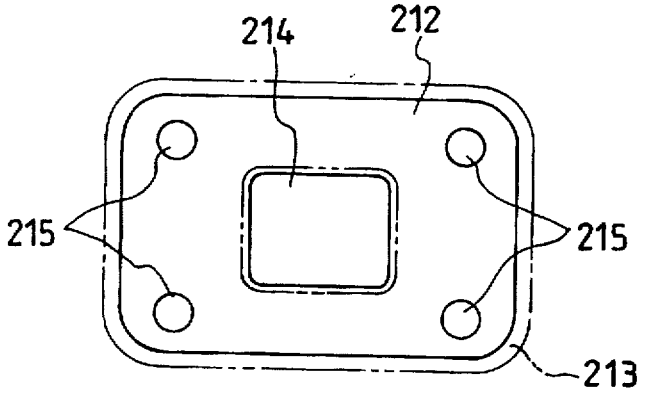
FIG. 23 is a bottom plan view of the embodiment shown in FIG. 21.

Due to this, when the present antenna unit is attracted to and held in the installation portion such as a roof panel or the like, as can he seen in FIG. 22, the PET sheet 214 bonded to the central portion of the synthetic resin sheet 212 is brought into contact with the roof panel R, and the lower portions (back portions) of the portions (respectively adjacent to the four corners) where the small-piece PET sheet 215, 215, 215, 215 are positioned are also brought into contact with the roof panel R.

Therefore, since the contact are a of the synthetic resin sheet 212 is increased when compared with a case in which the small-piece PET sheets 215 are not employed, the antenna unit does not slip, so that the antenna unit can be held stably in the installation portion such as a roof panel R or the like and also the contact portion of the synthetic resin sheet 212 is limited to the back side portions of the small-piece PET sheets 215. This eliminates the inconvenience effectively that, due to the overheated installation portion such as a roof panel R or the like, the synthetic resin sheet 212 bonded to the bottom surface of the main body part 210 may and adhere to the roof panel R or the like to thereby stain the roof panel R or the like and make it impossible to move and remove the antenna unit.

Figure 24:
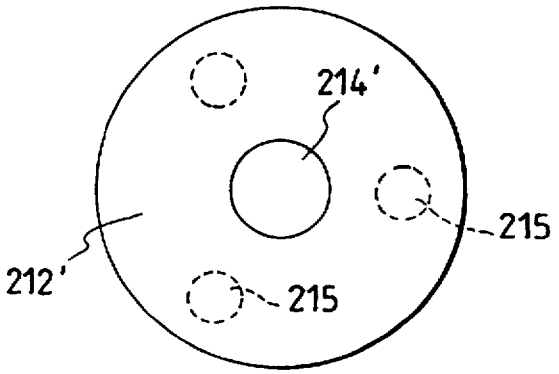
FIG. 24 is a bottom plan view of another embodiment according to the invention.
Figure 25:
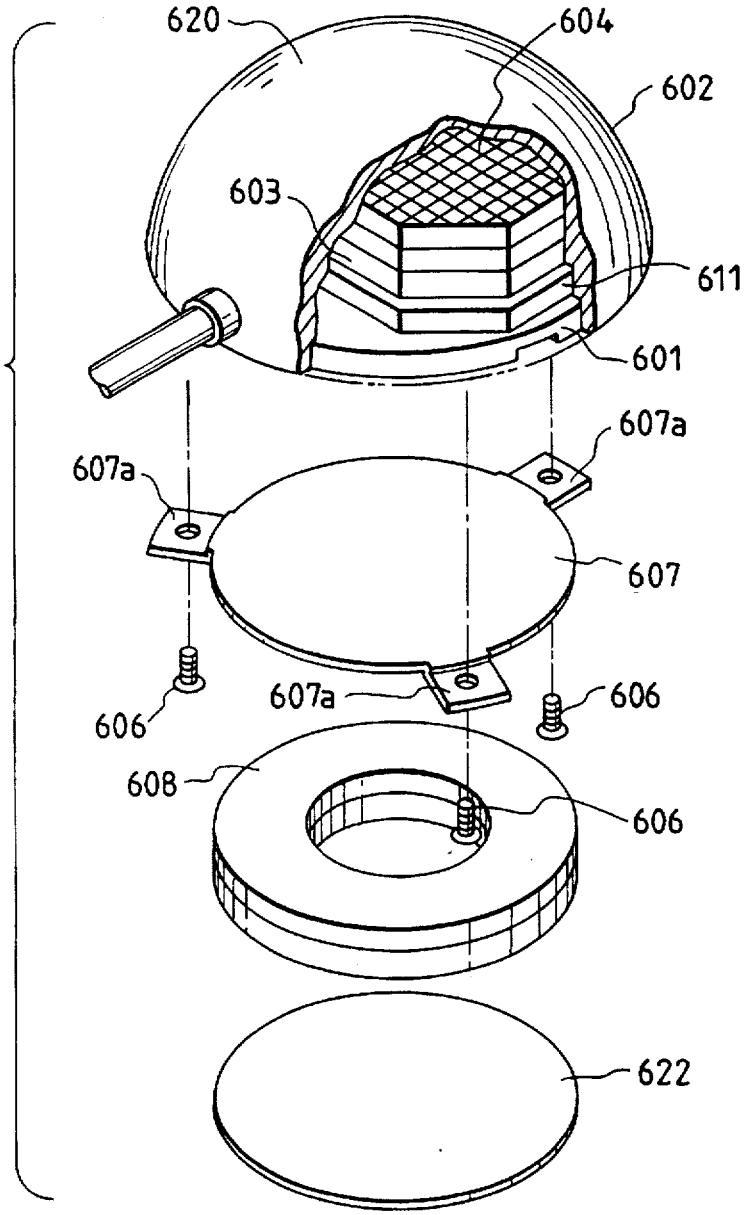
FIG. 25 is an exploded perspective view of another example of a conventional antenna unit.
Figure 26:
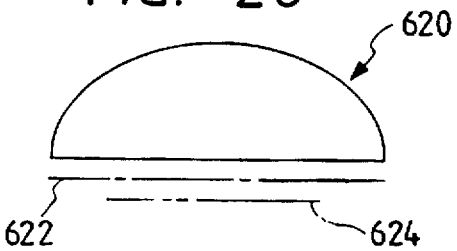
FIG. 26 is an illustration used to explain the conventional antenna unit shown in FIG. 25.
Figure 27:
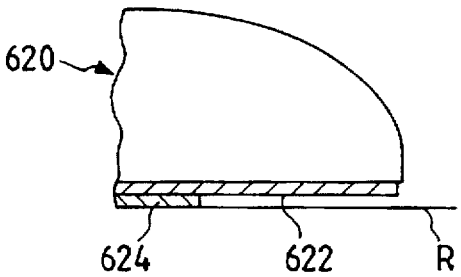
FIG. 27 is a partially enlarged view of the conventional antenna unit.

In the above embodiment, description has been given of a case in which the present invention is applied to an antenna unit having a rectangular bottom surface. However, the present invention can also be applied similarly to an antenna unit having a circular bottom surface. In this case, for example, preferably, as shown in FIG. 24, three small-piece PET sheets 215 are respectively bonded to the circular bottom surface of the main body part, that is, at three positions of the outer periphery thereof at regular angle intervals (120°), a circular synthetic resin sheet 212' is bonded to the lower surface side of the circular bottom surface, and a circular PET sheet 214' is bonded to the central portion of the lower surface side of the bottom surface.

As can be clearly understood from the foregoing description, according to the antenna unit of the invention, there can be effectively eliminated the inconvenience that, due to the overheated installation portion, the synthetic resin sheet bonded to the bottom surface of the main body part may melt and adhere to the same bottom surface to thereby stain the installation portion and make it impossible to move or remove the antenna unit. Also, there can be provided a sufficient slippage preventive force and thus the antenna unit can be held stably in the installation portion.

Fifth embodiment

Now, description will be given below of a plane antenna according to a fifth embodiment of the invention with reference to FIGS. 28 and 29.

Figure 28:
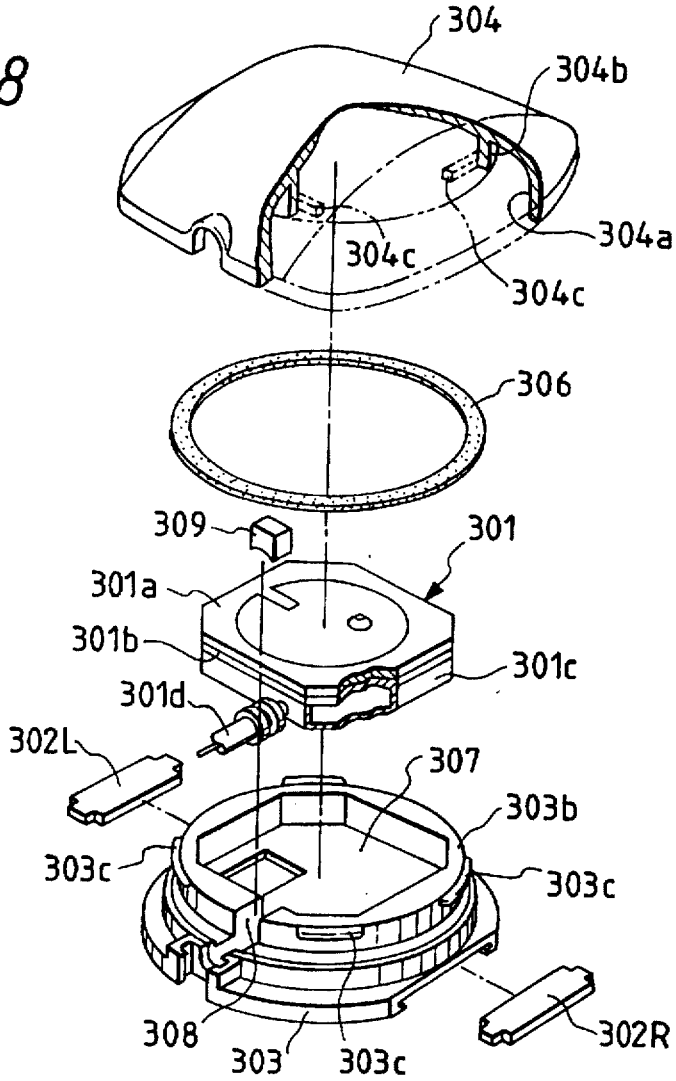
FIG. 28 is an exploded perspective view of a plane antenna according to a fifth embodiment of the invention.
Figure 29:
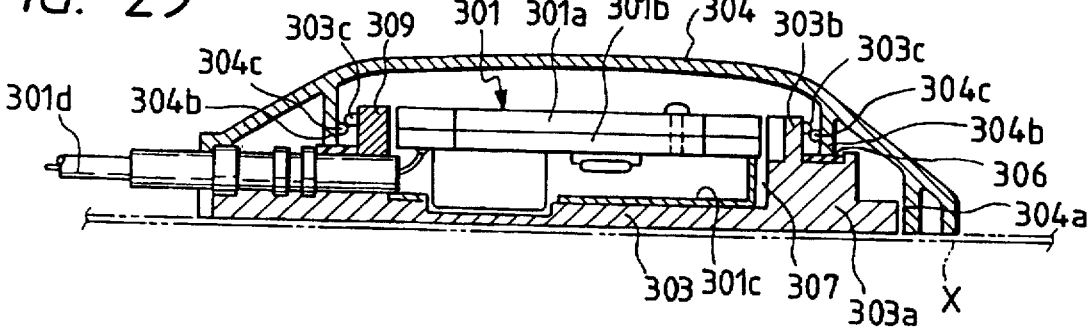
FIG. 29 is a section view of the plane antenna shown in FIG. 28.
Figure 30:
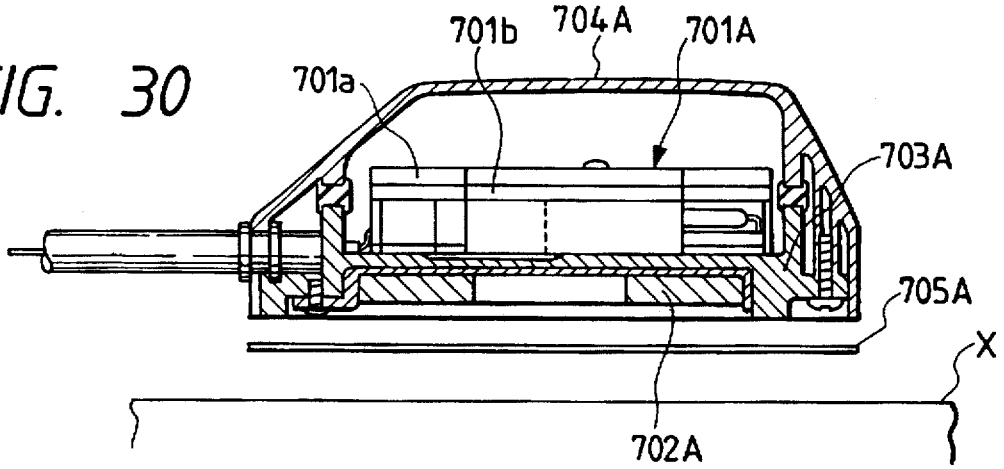
FIG. 30 is a side section view of a conventional plane antenna.

In particular, FIG. 28 is an exploded perspective view of an embodiment of a plane antenna according to the invention, and FIG. 29 is a cross-section view of the present embodiment. The plane antenna includes an antenna main body 301 which comprises an antenna element 301*a* and a circuit board 301*b* with accompanying circuit elements mounted thereon. And, the antenna main body 301*a*, similarly to the before-mentioned conventional one, can be attracted and mounted onto a vehicle roof panel X or the like while it is stored within a waterproof and dustproof case formed of resin.

In other words, as can be seen from FIGS. 28 and 29, the antenna main body 301, which is formed in a flat octagonal block with the opposite surface thereof to the antenna element 301*a* shielded by a shield box 301*c*, is stored between a bottom cover 303 and a top cover 304 (both of which will be described in detail later), and is connected to the GPS device (not shown) through a cable 301*d*.

The bottom cover 303 according to the present embodiment is injection molded from molding resin mixed with, for example, aluminum powder of the order of 5% into the following structure. After the antenna main body 301 is stored on the surface of the bottom cover 303, the bottom cover 303 is assembled to a cap-shaped top cover 304 which covers the whole surface of the bottom cover 303. In particular, the bottom cover 303 includes a bottom surface having a substantially circular outer periphery, a pair of permanent magnet pieces 302L and 302R to be attracted to the surface of the roof panel X due to the magnetic forces thereof are assembled integrally with the two sides of the bottom cover bottom surface, and a cylindrical seat portion 303*a* on which a packing 306 can be seated is integrally formed on the surface of the bottom surface.

And, the seat portion 303*a* includes on the inner periphery thereof a storage cylinder 303*b* which extends toward the top cover 304 and includes a cylindrical outer peripheral surface, and the storage cylinder 303*b* includes therein an octagonal space 307 in which the antenna main body 301 can be stored. When storing the antenna main body 301 into the octagonal space 307, the cable 301*d* of the antenna main body 301 is guided to the external of the resin case through a through groove which extends through the seat portion 303*a* and storage cylinder 303*b*.

Also, the top cover 304, in order to cover the whole bottom cover 303 is molded from normal molding resin not mixed with aluminum powder so that it will not interfere with the electric wave receiving operation to be performed by the antenna element 301*a*. The top cover 304 includes in the opening thereof a cylindrical opening surface 304*a* into which the cylindrical bottom cover 303 can be dropped, the cylindrical opening surface 304*a* includes on the inner periphery thereof a cylindrical projection 304*b* which is formed integral with the inner periphery and extends toward the end face of the seat portion 303*a*, and the leading end portion of the cylindrical projection 304*b* can be pressed against the 20 surface of the packing 306.

And, the cylindrical projection 304*b* includes on the inner peripheral surface thereof a plurality of engaging claws 304*c* which are respectively formed integrally with the inner peripheral surface and are disposed at regular intervals in the circumferential direction of the cylindrical projection 304*b*.

On the other hand, on the outer peripheral surface of the storage cylinder 303*b* corresponding to these engaging claws 304*c*, there are formed a plurality of locking claws 303*c* which are respectively connectable with their corresponding engaging claws 304*c* having a pitch angle inclined in the circumferential direction. The locking claws 303*c* are also formed integrally with the bottom cover 303.

Since the plane antenna according to the present embodiment has the above-mentioned structure, it can be assembled in the following manner: After the antenna main body 301 is positioned into the octagonal space 307 formed in the interior of the storage cylinder 303*b* and an embedding piece 309 is inserted into a stepped portion formed in the through groove 308 through which the cable 301*d* of the antenna main body 301 extends, if the packing 306 is fitted with the seat portion 303*a* and the top cover 304 is assembled to the bottom cover 303, then the present plane antenna can be assembled. In other words, the antenna main body 301, embedding piece 309 and packing 306 are assembled on the bottom cover 303, the center of the bottom cover 303 is aligned with the center of the top cover 304, and the cylindrical projection 304*b* of the top cover 304 is placed on the seat portion 303*a* of the bottom cover 303. Then, the top cover 304 is rotated with respect to the bottom cover 303, and the engaging claws 304*c* of the top cover 304 engaged with the locking claws 303*c* of the bottom cover 303, so that there can be obtained such an assembled state as shown in FIG. 29.

Sixth embodiment

Now, description will be given below in detail of a plane antenna according to a sixth embodiment of the invention with reference to FIGS. 31 and 32.

Figure 32:
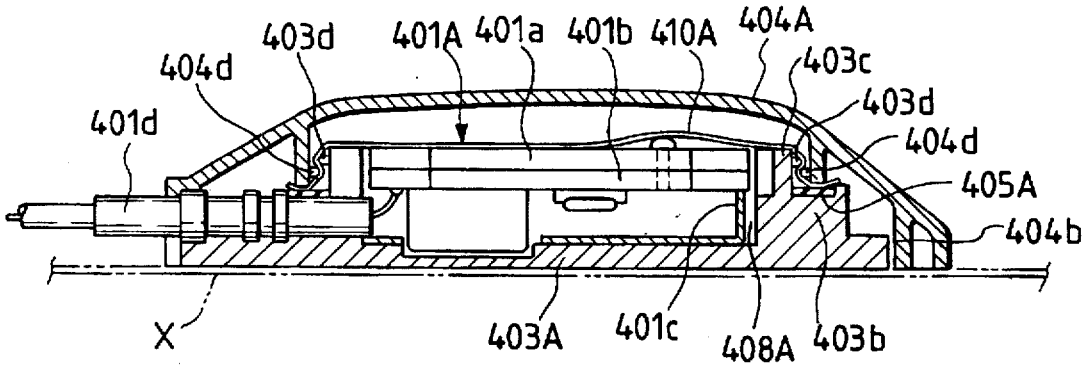
FIG. 32 is a section view of the plane antenna shown in FIG. 31.
Figure 31:
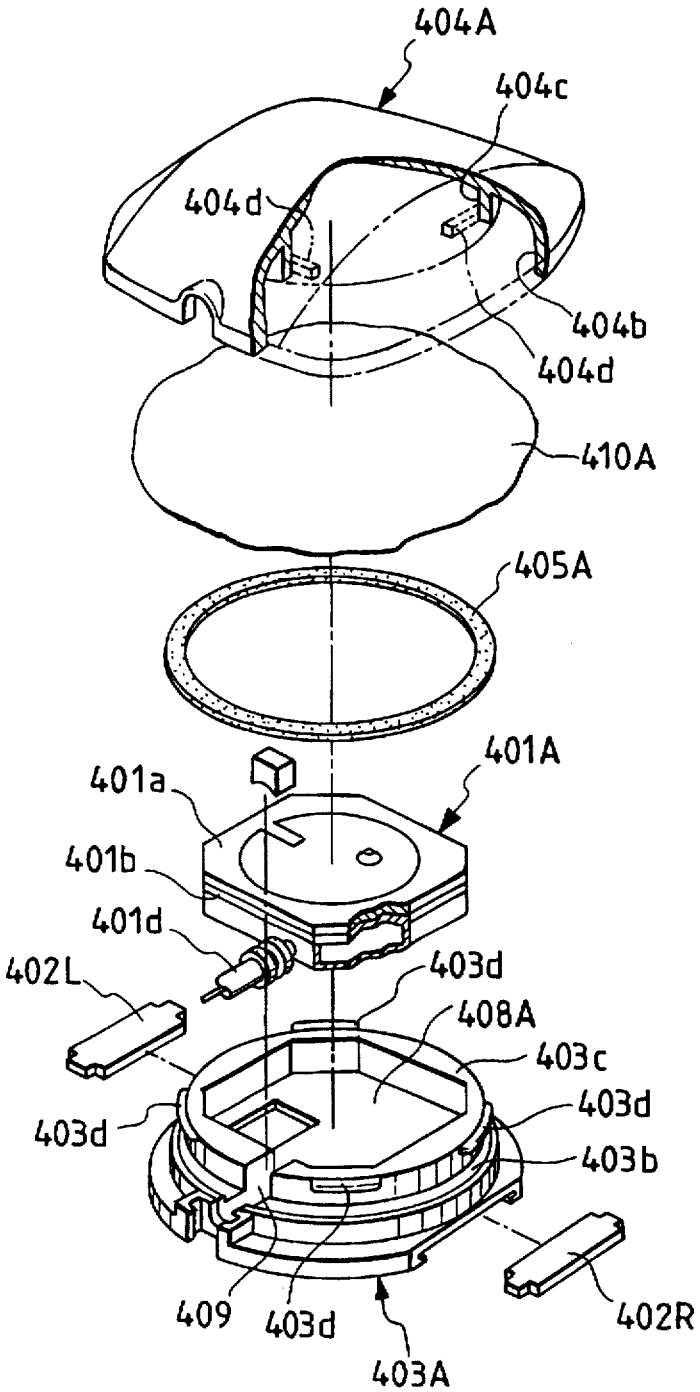
FIG. 31 is an exploded perspective view of a plane antenna according to a sixth embodiment of the invention.

FIGS. 31 and 32 respectively show a plane antenna according to a sixth embodiment of the invention. The present plane antenna includes an antenna main body 401A which comprises an antenna element 401*a* and a circuit board 401*b* with accompanying circuit elements mounted thereon. The antenna main body 401A, similarly to the before-mentioned conventional one, can be attracted and mounted onto a vehicle roof panel X or the like while it is stored in a waterproof and dustproof case formed of resin.

That is, as can be seen from FIGS. 31 and 32, the antenna main body 401A, which is formed in a flat octagonal block with the opposite surface thereof to the antenna element 401*a* shielded by a shield box 401*c*, is stored between a bottom cover 403A and a top cover 404A (both of which will be discussed later in detail), and is then connected to the GPS device (not shown) by means of a cable 401*d*.

A pair of permanent magnet pieces 402L and 402R to be attracted to the surface of the roof panel X due to the magnetic forces thereof are respectively formed integrally with the two sides of the bottom surface of the bottom cover 403A which is molded of resin, and a cylindrical seat portion 403*b* on which a packing 405A can be seated is formed integrally with the surface of the bottom surface of the bottom cover 403A.

And, on the inner periphery of the seat portion 403*b*, there is formed a storage cylinder 403*c* which extends toward the top cover 404A and includes a cylindrical outer peripheral surface. The storage cylinder 403*c* further includes therein a storage space 408A in which the antenna main body can be stored. When storing the antenna main body 401A into the storage space 408A, the cable 401*d* of the antenna main body 401A is guided externally of the resin case through a through groove 409 which extends through the seat portion 403*b* and storage cylinder 403*c*.

Also, the top cover 404A to cover the whole bottom cover 403A includes in the opening thereof a cylindrical opening surface 404*b* into which the bottom cover 403A can be positioned, the cylindrical opening surface 404*b* includes on the inner periphery thereof a cylindrical projection 404*c* which is formed integrally with the inner periphery and extends toward the end face of the seat portion 403*b*, and the leading end portion of the cylindrical projection 404*c* can be pressed against the surface of the packing 405A.

And, the cylindrical projection 404*c* includes on the inner peripheral surface thereof a plurality of engaging claws 404*d* which are respectively formed integrally with the inner peripheral surface and are disposed at regular intervals in the circumferential direction of the cylindrical projection 404*c*.

On the other hand, on the outer peripheral surface of the storage cylinder 403*c* corresponding to the engaging claws 404*d*, there are formed a plurality of locking claws 403*d* which are respectively formed integrally with the bottom cover 403A and are connectable with their corresponding engaging claws 404*d* having a pitch angle inclined in the circumferential direction.

Further, in the plane antenna according to the sixth embodiment of the invention, there is prepared a waterproof sheet 410A which is composed of a flexible polyethylene sheet or the like. The waterproof sheet 410A is inserted between the bottom cover 403A and top cover 404A when the bottom cover 403A and top cover 404A are assembled together by means of the engaging claws 404*d* and locking claws 403*d*. That is, since the waterproof sheet 410A is previously cut as a circular sheet which has an outside diameter dimension larger then the outer shape dimension of the seat portion 403*b* of the bottom cover 403A, after the antenna main body 401A is positioned in the storage space 408A, simply by placing the waterproof sheet 410A on the storage cylinder 403*c* of the bottom cover 403A and fixing the top cover 404A to the bottom cover 403A, there can be obtained such as assembled state as shown in FIG. 32.

Since the plane antenna according to the sixth embodiment has the above-mentioned structure, it can be assembled in the following manner: The antenna main body 401A is positioned into the storage space 408A formed within the storage cylinder 403*c*, the embedding piece 411 is inserted into the stepped portion of the through groove 409 through which the cable 401*d* of the antenna main body 401A extends, and the packing 405A is fitted on the seat portion 403*b*; and then, the waterproof sheet 410A is placed on the surface of the storage cylinder 403*c*, and the top cover 404A is assembled to the bottom cover 403A. In other words, the waterproof sheet 410A is placed on the surface of the opening of the storage cylinder 403*c* of the bottom cover 403A, the center of the bottom cover 403A is aligned with the center of the top cover 404A, and the cylindrical projection 404*c* of the top cover 404A is put on the seat portion 403*b* of the bottom cover 403A. Then, the top cover 404A is rotated with respect to the bottom cover 403A, and the engaging claws 404*d* of the top cover 404A are engaged with the locking claws 403*d* of the bottom cover 403A, so that there can be obtained such an assembled state as shown in FIG. 32.

In this assembled state, the outer peripheral portion of the waterproof sheet 410A is tightly held between the packing 405A and the leading end portion of the cylindrical projection 404*c* of the top cover 404A, and the inner side of the outer peripheral portion is held between the engaging claws 404*d* and locking claws 403*d*, so that the waterproof sheet 410A is spread tensely over the opening of the storage cylinder 403*c* of the bottom cover 403A. That is, the storage space 408A in which the antenna main body 401A is stored can be isolated from the outside by the waterproof sheet 410A tensely spread over the storage cylinder 403*c* of the bottom cover 403A, which can prevent the antenna main body 401A from degrading prematurely due to invasion of rainwater or the like into the storage space 408A.

Also, in the plane antenna according to the present embodiment, the periphery of the antenna main body 401A except for the antenna element 401*a* is shielded from the external electric and magnetic fields by the bottom cover 403 into which aluminum powder is mixed. Therefore, even without using a special aluminum evaporated sheet which is used in the conventional plane antenna, the present plane antenna can be protected against the effects of the external electric and magnetic fields. In other words, according to the present embodiment, there can be provided a plane antenna in which the number of parts can be reduced and the assembling process can be simplified.

Seventh embodiment

Figure 33:
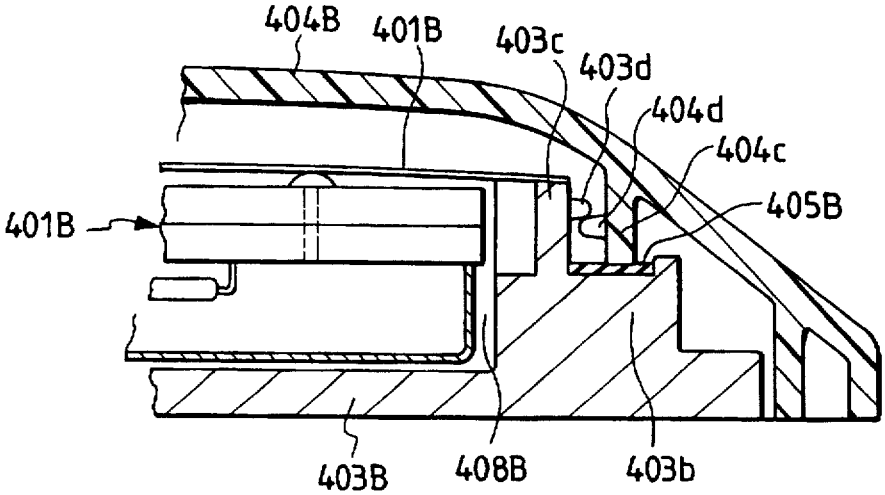
FIG. 33 is a section view of the main portions of a plane antenna according to a seventh embodiment of the invention.

Now, FIG. 33 is an enlarged section view of the main portions of a plane antenna according to a seventh embodiment of the invention. The seventh embodiment is similar to the sixth embodiment in that a bottom cover 403B includes on the surface thereof a cylindrical seat portion **403*b* on which a packing 405B can be seated and a storage cylinder 403*c* containing a storage space 408B in the central portion thereof, and also that a top cover 404B includes a cylindrical projection 404*c* which is formed integrally with the top cover 404B and extends toward the end face of the seat portion 403*b*. The bottom cover 403B and top cover 404B can be assembled together by engaging a plurality of engaging claws 404*d* formed in the inner peripheral surface of the cylindrical projection 404*c* with a plurality of locking claws 403*d* formed in the outer peripheral surface of the storage cylinder 403*c***.

In the seventh embodiment, between the bottom cover 403B and top cover **404*b* there is a waterproof sheet 410B which is identical with the outside diameter dimension of the storage cylinder 403*c* of the bottom cover 403B. For example, the surface of the outer peripheral portion of the waterproof sheet 410B which is formed of a waterproof and flexible polyethylene sheet or the like is bonded to the end face of the opening of the storage cylinder 403*c* by use of an adhesive and, therefore, the storage space 408B storing the antenna main body 401B therein is completely isolated from the outside by the waterproof sheet 410B, which can prevent the antenna main body 410B from degrading early due to invasion of rainwater and the like into the storage space 408B**.

Due to the fact that the plane antenna according to the seventh embodiment has the above-mentioned structure, after the antenna main body 401B is assembled into the storage cylinder **403*c* of the bottom cover 403B, simply by bonding the waterproof sheet 410B to the end face of the opening of the storage cylinder 403*c* to thereby seal the storage space 408B and assembling the bottom cover 403B and top cover 404B by means of the engaging claws 404*d* and locking claws 403*d***, there can be obtained similar operation effects to the sixth embodiment.

Eighth embodiment

Figure 34:
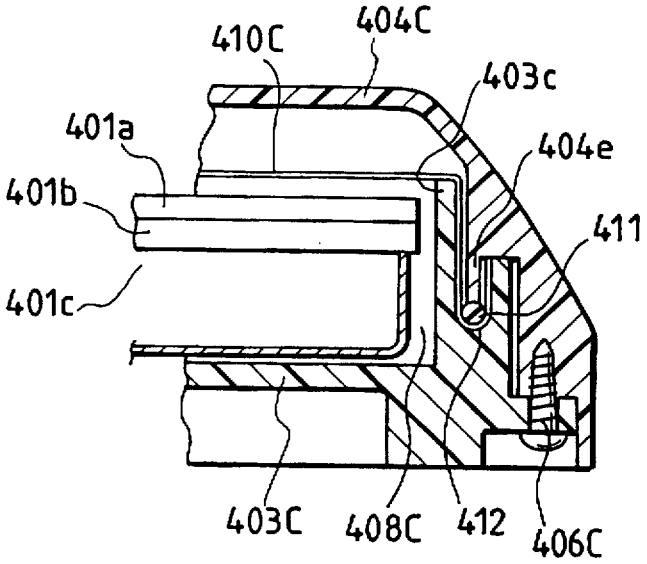
FIG. 34 is a section view of the main portions of a plane antenna according to a seventh embodiment of the invention.
Figure 35:
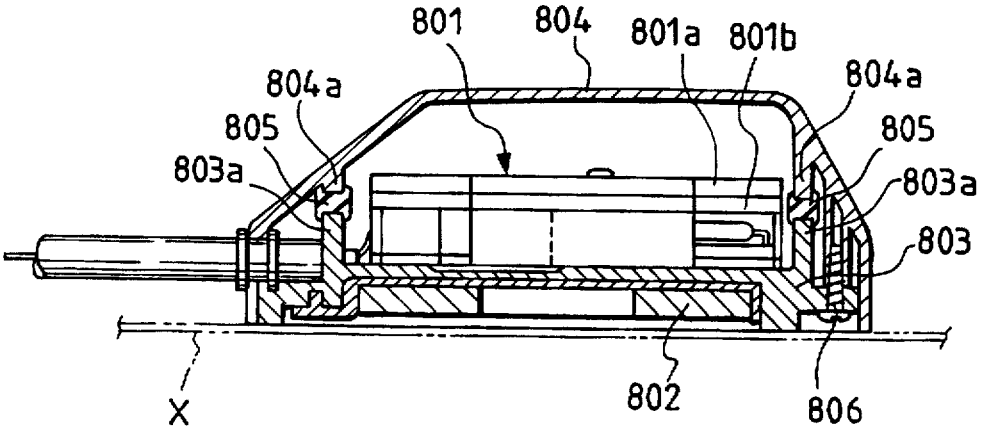
FIG. 35 is a section view of a conventional plane antenna.

FIG. 34 shows a plane antenna according to an eighth embodiment of the invention which is applied to a structure in which a bottom cover 403C and a top cover 404C are assembled together by use of an assembling screw 406C. The bottom cover 403C includes a storage space 408C in the central portion thereof and a storage cylinder **403*c* which is disposed around the storage space 408C into which the above-mentioned antenna element 401*a* and circuit board 401*b* are placed. And, in the base portion of the outer periphery of the storage cylinder 403*c*, there is formed a sealing groove 412 in which an O ring 411 can be stored. Also, there is used a waterproof sheet 410C which is sufficiently larger in area than the storage cylinder 403*c***.

On the other hand, on the inner surface of the top cover 404C, there is formed integrally therewith a pressure projection cylinder **404*e* which is opposed to the sealing groove 412. The leading end portion of the pressure projection cylinder 404*e* can secure the O ring 411 to the sealing groove 412**.

Since the plane antenna according to the eighth embodiment has the above-mentioned structure, after the antenna main body 401C consisting of the antenna element **401*a* and circuit board 401*b* is positioned into the storage space 408C, if the central portion of the waterproof sheet 410C is applied to the opening of the storage cylinder 403*c* and the peripheral portion of the waterproof sheet 410C is secured to the outer surface of the storage cylinder 403*c* by use of the O ring 411, then the storage space 408C can be sealed. In other words, if the top cover 404C is tightened to the bottom cover 403C by use of the assembling screw 406C, in the leading end portion of the pressure projection cylinder 404*e* of the top cover 404C, the O ring 411 pressed against the sealing groove 412, so that the peripheral portions of the waterproof sheet 410C can be fixed in a liquid tight manner to the base portion of the storage cylinder 403*c***.

As a result of this, similarly to the above-mentioned embodiments, in the structure of the eighth embodiment as well, since the storage space 408C with the antenna main body 410C incorporated therein can be surely sealed, the premature deterioration or degradation of the antenna main body 410C due to rainwater and the like can be prevented.

As can be seen clearly from the foregoing description, according to the invention, since a waterproof sheet is spread between a bottom cover and a top cover even in a plane antenna in which the bottom cover and top cover cannot be fixed tightly together a storage space in which an antenna main body is stored can be sealed perfectly. Therefore, according to the invention, the antenna main body can be kept from degrading prematurely due to rainwater and the like, so that there can be provided a plane antenna having an extended life.

As can be understood clearly from the above description, according to the invention, since a bottom cover is formed of resin mixed with aluminum powder, even without using an aluminum evaporated sheet, the peripheral portions of an antenna main body except for an antenna element can be shielded perfectly from the external electric and magnetic fields. Therefore, according to the invention, there can be provided a plane antenna in which, by eliminating the aluminum evaporated sheet used in the conventional plane antenna, the number of parts can be reduced and the assembling process thereof can be simplified.

What is claimed is:

1. An antenna unit for use in a navigation system comprising:

a bottom cover;

a unit case connectable to said bottom cover;

a circuit board and an antenna main body positionable in said bottom cover, wherein said bottom cover and said unit case comprise a continuous enclosure case for preventing ingress of contaminants, said bottom cover including a cylindrical storage portion for receiving said circuit board, and said antenna main body, said cylindrical storage portion being formed integrally with said bottom cover, said cylindrical storage portion including a first surface having first threads, said unit case having a cylindrical joint portion including a second surface having second threads, wherein said first threads are connectable with said second threads, said cylindrical joint portion being formed integrally with said unit case, said antenna unit further comprising a waterproof seal positioned between said cylindrical storage portion and said cylindrical joint portion for sealing said cylindrical storage portion.

2. An antenna unit for use in a navigation system as set forth in claim 1, wherein said bottom cover includes a recessed portion, said antenna unit further comprising a permanent magnet and a back yoke positionable in said recessed portion, said recessed portion being formed in a bottom portion of said cylindrical storage portion, said unit circuit board having a surface facing said recessed portion and being covered with a shield case, and said antenna main body being held in said cylindrical storage portion by a magnetic force of said permanent magnet.

3. An antenna unit for use in a navigation system as set forth in claim 2, wherein an outside dimension of said bottom cover is less than that of an outside dimension of said unit case.

4. An antenna unit for use in a navigation system as set forth in claim 2, wherein an outside dimension of said bottom cover is less than that of an outside dimension of said unit case.

5. An antenna unit for use in a navigation system as set forth in claim 1, wherein an outside dimension of said bottom cover is less than that of an outside dimension of said unit case.

6. An antenna unit for use in a navigation system as set forth in claim 1, wherein an outside dimension of said bottom cover is less than that of an outside dimension of said unit case.

7. An antenna unit as in claim 1, wherein said bottom cover includes a seal receiving portion for supporting said waterproof seal.

8. An antenna unit comprising:

a case for enclosing a circuit board and an antenna main body, said case including a bottom cover and a top cover, said bottom cover including a lower surface;

a stabilizing shield plate, mounted on the lower surface of said bottom cover, for stabilizing an electric wave receiving condition of said antenna unit;

a cable connected to said circuit board;

a draw-out opening, formed in said top cover, for drawing said cable externally out of said top cover, wherein said draw-out opening has a lower portion having a cut-away portion, a width of said cutaway portion being less than that of an outside diameter of said draw-out opening.

9. An antenna unit comprising:

a case for enclosing a circuit board and an antenna main body, said case including a bottom cover and a top cover, said bottom cover including a plurality of engaging wall portions respectively situated along a first circumference said engaging wall portions including a plurality of inclined projecting strips, and said top cover including a plurality of projections for connecting with said projecting strips, wherein when said top cover is rotated with respect to said bottom cover, said top cover becomes connected to said bottom cover.

10. An antenna unit as set forth in claim 9, wherein said bottom cover includes a recessed portion and said top cover includes a securing piece, wherein said recessed portion is engageable with said securing piece for preventing said bottom cover from being disconnected from said top cover.

11. An antenna unit as in claim 9, wherein said engaging wall portions are spaced from one another at regular intervals along said first circumference.

12. An antenna unit comprising:

a case for enclosing a circuit board and an antenna main body, said case including a bottom cover and a top cover, said bottom cover including side portions having a plurality of insertion portions, each insertion portion of said insertion portions having an opening facing a respective side portion of said side portions;

said bottom cover including a lower portion having a plurality of securing portions;

a plurality of magnets positioned in said insertion portions; and a plurality of back yokes positioned adjacent said magnets.

13. An antenna unit comprising:

a cover for enclosing an antenna main body and a mounting magnet, said antenna main body being connected to said cover by a magnetic force of said mounting magnet, said cover having a bottom surface, said bottom surface having an outer peripheral portion;

a plurality of polyethylene terephthalate (PET) sheets connected to a plurality of positions of the outer peripheral portion of the bottom surface of said cover such that said PET sheets are spaced from one another; and a synthetic resin sheet, having a first side, a second side and a central portion, said synthetic resin sheet being connected to the bottom surface of said cover such that said first side of said synthetic resin sheet covers the bottom surface of said cover and said PET sheets; and a central PET sheet connected to the central portion of said second side of said synthetic resin sheet, wherein said PET sheets are positioned outside said central portion.

14. A plane antenna comprising:

a resin case;

an antenna element positionable in said resin case;

a circuit board, positionable in said case, having circuit elements, said resin case including a bottom cover and a top cover for covering the surface of the bottom cover, said bottom cover including a storage space, said storage space having an opening for receiving said antenna element and said circuit board; and a waterproof sheet positioned between said top cover and said bottom cover such that said waterproof sheet covers at least said opening in the storage space of said bottom cover.

15. A plane antenna as set forth in claim 14, wherein said bottom cover includes a seat portion, said plane antenna further comprising a packing positioned on said seat portion, said storage space comprising a storage cylinder into which said antenna element and circuit board are positionable, said storage cylinder including an outer peripheral surface having locking claws, said top cover including a cylindrical projection for pressing said packing against said seat portion, said cylindrical projection including engaging claws, said engaging claws forming a connection with said locking claws, said waterproof sheet covering said seat portion, and said waterproof sheet being held in position between said bottom cover and said top cover by said connection of said engaging claws of said cylindrical projection and said locking claws of the outer peripheral surface of said storage cylinder.

16. A plane antenna as set forth in claim 14, wherein said storage space includes a central portion comprising a storage cylinder having an opening into which said antenna element and circuit board are positionable, said opening being surrounded by an opening surface, and said waterproof sheet having a size corresponding to the opening surface of said storage cylinder, wherein said waterproof sheet is bonded to said opening surface.

17. A plane antenna as set forth in claim 14, wherein said bottom cover and said top cover are connected by at least one assembling screw, said storage space having a central portion comprising a storage cylinder into which said antenna element and said circuit board are positionable, said storage cylinder having an outer periphery base portion having a sealing groove, said plane antenna further comprising an O-ring positionable on said sealing groove on the outer periphery base portion of said storage cylinder, said top cover including a pressure projection corresponding to said sealing groove, said O-ring being secured between said sealing groove and said pressure projection of said top cover, said waterproof sheet including an outer periphery secured between said sealing groove and said O-ring.

* * * * *